US008414115B2

(12) United States Patent
Shibata

(10) Patent No.: US 8,414,115 B2
(45) Date of Patent: Apr. 9, 2013

(54) LIQUID SUPPLYING APPARATUS AND LIQUID EJECTING APPARATUS

(75) Inventor: Hiroshi Shibata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 95 days.

(21) Appl. No.: 13/194,530

(22) Filed: Jul. 29, 2011

(65) Prior Publication Data

US 2012/0026256 A1 Feb. 2, 2012

(30) Foreign Application Priority Data

Jul. 30, 2010 (JP) ..... 2010-172786

(51) Int. Cl.
*B41J 2/175* (2006.01)

(52) U.S. Cl.
USPC ..... 347/85

(58) Field of Classification Search ..... 347/84–86, 347/89, 93, 95, 14, 23, 30
See application file for complete search history.

(56) References Cited

U.S. PATENT DOCUMENTS 6,003,983 A * 12/1999 Lowry et al. ..... 347/85
8,215,757 B2 * 7/2012 Kuribayashi et al. ..... 347/89
2007/0058009 A1 3/2007 Furukawa et al.
2008/0198207 A1 * 8/2008 Katada ..... 347/85
2011/0050817 A1 * 3/2011 Tamada et al. ..... 347/85

FOREIGN PATENT DOCUMENTS

WO 2007-76016 A 3/2007

* cited by examiner

*Primary Examiner* — Kristal Feggins
(74) *Attorney, Agent, or Firm* — Birch, Stewart, Kolasch & Birch, LLP

(57) ABSTRACT

A liquid supplying apparatus includes: a pressure applying device applying pressure to the liquid inside a supply flow channel connected to a liquid supply object; a pressure buffering unit including a deformable or movable partition separating a liquid chamber connected to the supply flow channel and a gas chamber; a gas flow channel switching device connecting and disconnecting the gas chamber and a gas storage unit; an atmosphere connection channel switching device connecting and disconnecting the gas storage unit to and from the atmosphere; a switching controlling device controlling operations of the gas flow channel switching device and the atmosphere connection channel switching device during initial position adjustment of the partition and during pressurization of the liquid supply object; and a pressure controlling device controlling the pressure applying device in response to the operations of the gas flow channel switching device and the atmosphere connection channel switching device.

21 Claims, 17 Drawing Sheets

LIQUID SUPPLYING APPARATUS AND LIQUID EJECTING APPARATUS

BACKGROUND OF THE INVENTION

1. Field of the Invention

The present invention relates to a liquid supplying apparatus and a liquid ejecting apparatus, more particularly to a pressure control technique in a liquid supplying apparatus which supplies liquid to an inkjet head or the like.

2. Description of the Related Art

In order to stably operate an inkjet head and to stably supply ink to the inkjet head, internal pressure of the inkjet head and pressure of an ink flow channel should be controlled to be constant. A pump arranged in the ink flow channel is used as a device that controls such pressure. Meanwhile, when a pump is used to control the internal pressure of the inkjet head or the pressure of the ink flow channel, a pressure fluctuation attributable to a pulsating flow of the pump or the like may occur. Such a pressure fluctuation not only obstructs stable ink supply but may also interfere with stable operations of the inkjet head.

On the other hand, techniques are known in which a damper is arranged in an ink flow channel to suppress a pressure fluctuation in the ink flow channel or a fluctuation in internal pressure of an inkjet head. For example, a technique is known in which a capacity of a sub tank connected to an ink flow channel is varied to have the sub tank function as a damper which suppresses a pressure fluctuation in the ink flow channel.

Japanese Patent Application Publication No. 2007-076016 discloses an ink supply container having a configuration in which a capacity regulating device suppresses expansion of a flexible member of an ink container when setting an internal pressure of the ink container to a positive pressure to perform cleaning and restoration of a nozzle of a recording head, the capacity regulating device does not suppress expansion of the flexible member of the ink container when setting the internal pressure of the ink container to a negative pressure to perform printing by the recording head, a capacity when the internal pressure of the ink container is set to a positive pressure is kept approximately equal to a capacity when the internal pressure of the ink container is set to a negative pressure suitable for printing, and when cleaning and restoration is performed according to a pressurizing recovery method, the internal pressure of the ink container is set to a negative pressure optimal for printing by merely discharging a small amount of ink from the ink container.

However, an apparatus which realizes high-speed printing, high-quality printing, and printing on large-size media consumes a large amount of ink and a significant pressure variation occurs in an ink supply channel during ejection by an inkjet head. A large-sized damper mechanism is required for suppressing such significant pressure variations. With the configuration disclosed in Japanese Patent Application Publication No. 2007-076016, a stroke of the capacity regulating device needs to be increased to secure buffering performance. At the same time, increasing the stroke of the capacity regulating device inevitably results in an increased size of the apparatus. In addition, with the configuration disclosed in Japanese Patent Application Publication No. 2007-076016, since a positional variation of the flexible member occurs over time due to operations associated with pressure fluctuations, pressure control characteristics also change.

SUMMARY OF THE INVENTION

The present invention has been contrived in view of these circumstances, an object thereof being to provide a liquid supplying apparatus and a liquid ejecting apparatus capable of suppressing a fluctuation of internal pressure of a liquid ejection head and a pressure fluctuation of a liquid flow channel, preventing pressure control characteristics from fluctuating over time, reducing processing time during pressurization, and obtaining pressurization characteristics based on a sharp pressure curve during pressurization.

In order to attain the aforementioned object, the present invention is directed to a liquid supplying apparatus configured to supply liquid to a liquid supply object, the apparatus comprising: a supply flow channel which is connected to the liquid supply object; a first pressure applying device which applies pressure to the liquid inside the supply flow channel; a first pressure buffering unit including a first liquid chamber which is connected to the supply flow channel, a first gas chamber which stores a gas, and a first partition which separates the first liquid chamber and the first gas chamber from each other, the first partition being deformable or movable so as to vary a volume of the first liquid chamber; a first gas flow channel of which one end is connected to the first gas chamber; a first gas storage unit which is connected to the other end of the first gas flow channel; a first gas flow channel switching device which opens and closes to connect and disconnect the first gas chamber and the first gas storage unit to and from each other; a first atmosphere connection channel of which one end is connected to the first gas storage unit and the other end is connected to atmosphere; a first atmosphere connection channel switching device which opens and closes to connect and disconnect the first gas storage unit to and from the atmosphere; a first switching controlling device which controls operations of the first gas flow channel switching device and the first atmosphere connection channel switching device during initial position adjustment of the first partition and during pressurization of the liquid supply object; and a first pressure controlling device which controls an operation of the first pressure applying device in response to the operations of the first gas flow channel switching device and the first atmosphere connection channel switching device controlled by the first switching controlling device.

According to this aspect of the present invention, the first pressure buffering unit is arranged in the supply flow channel which is connected to the liquid supply object, the first pressure buffering unit having the structure in which the first liquid chamber and the first gas chamber are separated from each other by the first partition and the first gas chamber is connected to a first gas storage unit through the first gas flow channel and the first gas flow channel switching device, the first gas storage unit has the structure which enables the first gas storage unit to be connected to the atmosphere through the first atmosphere connection channel and the first atmosphere connection channel switching device, switching can be performed between the first gas flow channel switching device and the first atmosphere connection channel switching device during the initial position adjustment of the first partition and during the pressurization of the liquid supply object, and the operation of the first pressure applying device is controlled according to operations of the first gas flow channel switching device and the first atmosphere connection channel switching device. Therefore, the fluctuation of pressure control over time may be suppressed by performing the initial position adjustment of the first partition, favorable pressure is secured during the pressurization of the liquid supply object, the pressure buffering function of the first pressure buffering unit acts during the supplying of the liquid, and favorable liquid supply with suppressed pressure fluctuation is achieved.

Specific examples of the liquid supply object include a liquid ejection head (inkjet head). A preferable mode includes a supply flow channel switching device which opens and closes to connect and disconnect the supply object and the supply flow channel to and from each other.

It is preferable that each of the first gas flow channel switching device and the first atmosphere connection channel switching device is a control valve of which opening and closing can be controlled according to a control signal.

It is preferable that the first pressure applying device is a pump capable of switching between increasing and reducing the internal pressure of the first flow channel. More specifically, the pressure of the first flow channel can be increased or reduced by switching between ejection and suction by switching rotational directions of the pump.

Preferably, upon start of the initial position adjustment of the first partition, the first switching controlling device controls the first gas flow channel switching device and the first atmosphere connection channel switching device to open, and when the first partition becomes adjusted to an initial position, the first switching controlling device then controls the first atmosphere connection channel switching device to close; and when the first switching controlling device controls the first gas flow channel switching device and the first atmosphere connection channel switching device to open during the initial position adjustment of the first partition, the first pressure controlling device controls the first pressure applying device to pressurize the first liquid chamber to expand the first liquid chamber further than that in an initial state in which the first partition is at the initial position, and when the first liquid chamber reaches a predetermined volume, the first pressure controlling device then controls the first pressure applying device to depressurize the first liquid chamber to cause the first liquid chamber to contract by an amount equivalent to an amount of expansion from the initial state.

According to this aspect of the present invention, by appropriately adjusting the initial position of the first partition provided in the first pressure buffering unit, an occurrence of a variance in pressure control can be avoided.

It is preferable that the first partition is an elastic membrane which elastically deforms in response to a pressure fluctuation of the first liquid chamber.

Preferably, the liquid supplying apparatus further comprises: a first pressure measuring device which measures pressure of the supply flow channel or the first liquid chamber; and a first data storage device in which a relationship between the pressure measured by the first pressure measuring device and the volume of the first liquid chamber is stored, wherein the first pressure controlling device controls the first pressure applying device to stop when a measurement result of the first pressure measuring device assumes a specified pressure stored in the first data storage device correspondingly to the volume of the first liquid chamber when the first liquid chamber is expanded further than that in the initial state.

According to this aspect of the present invention, the state of the first liquid chamber can be determined from the pressure measured by the first pressure measuring device, and favorable pressure control can be executed.

In this mode, "specified pressure" means a predetermined pressure within a range in which the volume and the pressure of the liquid chamber maintain a proportional relationship.

Preferably, the first pressure controlling device controls the first pressure applying device to operate for a predetermined period of time to cause the liquid inside the first liquid chamber to be discharged at a certain flow rate when contracting the first liquid chamber further than that in a state in which the first liquid chamber has been expanded during the initial position adjustment of the first partition.

According to this aspect of the present invention, the initial position of the first partition can be accurately adjusted.

In this mode, it is preferable that the liquid supplying apparatus further comprises an elapsed time measuring device which measures an elapsed time from a start of contraction of the first liquid chamber (from a switching timing of the pressure application control).

Preferably, upon start of the pressurization of the liquid supply object, the first switching controlling device controls the first gas flow channel switching device and the first atmosphere connection channel switching device to open, and when the first partition becomes deformed or moved to maximize the volume of the first liquid chamber, the first switching controlling device then controls the first gas flow channel switching device and the first atmosphere connection channel switching device to close; and when the first switching controlling device controls the first gas flow channel switching device and the first atmosphere connection channel switching device to open during the pressurization of the liquid supply object, the first pressure controlling device controls the first pressure applying device to pressurize the first liquid chamber to deform or move the first partition and operates to cause the volume of the first liquid chamber to become maximum.

According to this aspect of the present invention, during the pressurization of the liquid supply object, the first partition can be fixed in the state in which the volume of the first liquid chamber is the maximum.

In this mode, the "pressurization of the liquid supply object" includes pressurizing purge (preliminary election) of an inkjet head.

Preferably, when the first partition becomes deformed or moved to maximize the volume of the first liquid chamber and the first switching controlling device controls the first gas flow channel switching device and the first atmosphere connection channel switching device to close, the first pressure controlling device controls the first pressure applying device to pressurize the supply flow channel so as to pressurize the liquid supply object.

According to this aspect of the present invention, favorable pressurization is executed on the liquid supply object using the pressure accumulated in the first pressure buffering unit and the supply flow channel.

Preferably, the first pressure buffering unit includes: a flexible membrane which serves as the first partition; and a sealed container which is separated by the flexible membrane into the first liquid chamber and the first gas chamber.

According to this aspect of the present invention, the volume of the first liquid chamber can be expanded in accordance with an amount of the liquid flowing into the first liquid chamber, and the pressure fluctuation occurring in the supply flow channel can be buffered.

Preferably, in the first pressure buffering unit, an inner wall of the first gas chamber has a curved surface.

According to this aspect of the present invention, an improvement in durability of the first partition may be expected.

Preferably, the liquid supplying apparatus further comprises: a recovery flow channel which is connected to the liquid supply object; a second pressure applying device which applies pressure to the liquid inside the recovery flow channel; a second pressure buffering unit including a second liquid chamber which is connected to the recovery flow channel, a second gas chamber which stores a gas, and a second partition which separates the second liquid chamber and the second gas chamber from each other, the second partition being deformable or movable so as to vary a volume of the second liquid chamber; a second gas flow channel of which one end is connected to the second gas chamber; a second gas storage unit which is connected to the other end of the second gas flow channel; a second gas flow channel switching device which opens and closes to connect and disconnect the second gas chamber and the second gas storage unit to and from each other; a second atmosphere connection channel of which one end is connected to the second gas storage unit and the other end is connected to the atmosphere; a second atmosphere connection channel switching device which opens and closes to connect and disconnect the second gas storage unit to and from the atmosphere; a second switching controlling device which controls operations of the second gas flow channel switching device and the second atmosphere connection channel switching device during recycling in which the liquid is recycled from the liquid supply object through the recovery flow channel, during initial position adjustment of the second partition, and during pressurization of the liquid supply object; and a second pressure controlling device which controls an operation of the second pressure applying device in response to the operations of the second gas flow channel switching device and the second atmosphere connection channel switching device controlled by the second switching controlling device.

In this aspect of the present invention, the first pressure controlling device can also serve as the second pressure controlling device, and the first switching controlling device can also serve as the second switching controlling device.

Preferably, during the recycling in which the liquid is recycled from the liquid supply object through the recovery flow channel: the first switching controlling device controls the operations of the first gas flow channel switching device and the first atmosphere connection channel switching device; and the first pressure controlling device controls the first pressure applying device in response to the operations of the first gas flow channel switching device and the first atmosphere connection channel switching device controlled by the first switching controlling device.

According to this aspect of the present invention, the supply system and the recycling system can be controlled independently.

Preferably, during the recycling in which the liquid is recycled from the liquid supply object through the recovery flow channel: the first switching controlling device controls the first gas flow channel switching device to open and controls the first atmosphere connection channel switching device to close; the second switching controlling device controls the second gas flow channel switching device to open and controls the second atmosphere connection channel switching device to close; the first pressure controlling device controls the first pressure applying device to generate a pressure difference between the supply flow channel and the recovery flow channel; and the second pressure controlling device controls the second pressure applying device to generate the pressure difference between the supply flow channel and the recovery flow channel.

According to this aspect of the present invention, the recycling of the liquid is executed under favorable pressure control.

Preferably, the liquid supplying apparatus further comprises: a connection flow channel through which the supply flow channel and the recovery flow channel are connected to each other; a connection flow channel switching device which opens and closes to connect and disconnect the supply flow channel and the recovery flow channel to and from each other; and a connection flow channel switching controlling device which controls an operation of the connection flow channel switching device so as to connect the supply flow channel and the recovery flow channel to each other during the recycling in which the liquid is recycled from the liquid supply object through the recovery flow channel.

According to this aspect of the present invention, an occurrence of a temperature fluctuation due to a drop in flow rates in the supply flow channel and the recovery flow channel can be avoided.

This mode is particularly effective in a structure in which the liquid flow channel branches from a temporary storage unit which is connected to a supply flow channel.

Preferably, upon start of the initial position adjustment of the second partition, the second switching controlling device controls the second gas flow channel switching device and the second atmosphere connection channel switching device to open, and when the second partition becomes adjusted to an initial position, the second switching controlling device then controls the second atmosphere connection channel switching device to close; and when the second switching controlling device controls the second gas flow channel switching device and the second atmosphere connection channel switching device to open during the initial position adjustment of the second partition, the second pressure controlling device controls the second pressure applying device to pressurize the second liquid chamber to expand the second liquid chamber further than that in an initial state in which the second partition is at the initial position, and when the second liquid chamber reaches a predetermined volume, the second pressure controlling device then controls the second pressure applying device to depressurize the second liquid chamber to cause the second liquid chamber to contract by an amount equivalent to an amount of expansion from the initial state.

According to this aspect of the present invention, the initial position of the second partition can be accurately adjusted.

Preferably, the liquid supplying apparatus further comprises: a second pressure measuring device which measures pressure of the recovery flow channel or the second liquid chamber; and a second data storage device in which a relationship between the pressure measured by the second pressure measuring device and the volume of the second liquid chamber is stored, wherein the second pressure controlling device controls the second pressure applying device to stop when a measurement result of the second pressure measuring device assumes a specified pressure stored in the second data storage device correspondingly to the volume of the second liquid chamber when the second liquid chamber is expanded further than that in the initial state.

According to this aspect of the present invention, the state of the second liquid chamber can be determined from the pressure measured by the second pressure measuring device, and favorable pressure control can be executed.

Preferably, the second pressure controlling device controls the second pressure applying device to operate for a predetermined period of time to cause the liquid inside the second liquid chamber to be discharged at a certain flow rate when contracting the second liquid chamber further than that in a state in which the second liquid chamber has been expanded during the initial position adjustment of the second partition.

According to this aspect of the present invention, the initial position of the second partition can be accurately adjusted.

In this mode, it is preferable that the liquid supplying apparatus further comprises an elapsed time measuring device which measures an elapsed time from a start of contraction of the second liquid chamber (from a switching timing of the pressure application control).

Preferably, upon start of the pressurization of the liquid supply object, the second switching controlling device controls the second gas flow channel switching device and the second atmosphere connection channel switching device to open, and when the second partition becomes deformed or moved to maximize the volume of the second liquid chamber, the second switching controlling device then controls the second gas flow channel switching device and the second atmosphere connection channel switching device to close; and when the second switching controlling device controls the second gas flow channel switching device and the second atmosphere connection channel switching device to open during the pressurization of the liquid supply object, the second pressure controlling device controls the second pressure applying device to pressurize the second liquid chamber to deform or move the second partition and operates to cause the volume of the second liquid chamber to become maximum.

According to this aspect of the present invention, during the pressurization of the liquid supply object, in a similar manner to the first partition, the second partition can be fixed in the state in which the volume of the second liquid chamber is the maximum.

Preferably, when the second partition becomes deformed or moved to maximize the volume of the second liquid chamber and the second switching controlling device controls the second gas flow channel switching device and the second atmosphere connection channel switching device to close, the second pressure controlling device controls the second pressure applying device to pressurize the supply flow channel so as to pressurize the liquid supply object.

According to this aspect of the present invention, favorable pressurization is executed on the liquid supply object using the pressure accumulated in the second pressure buffering unit and the recovery flow channel.

Preferably, the second pressure buffering unit includes: a flexible membrane which serves as the second partition; and a sealed container which is separated by the flexible membrane into the second liquid chamber and the second gas chamber.

Preferably, in the second pressure buffering unit, an inner wall of the second gas chamber has a curved surface.

In order to attain the aforementioned object, the present invention is also directed to a liquid ejecting apparatus, comprising: a liquid ejection head which ejects liquid; and a liquid supplying apparatus which supplies the liquid to the liquid ejection head, wherein the liquid supplying apparatus includes: a supply flow channel which is connected to the liquid ejection head; a first pressure applying device which applies pressure to the liquid inside the supply flow channel; a first pressure buffering unit including a first liquid chamber which is connected to the supply flow channel, a first gas chamber which stores a gas, and a first partition which separates the first liquid chamber and the first gas chamber from each other, the first partition being deformable or movable so as to vary a volume of the first liquid chamber; a first gas flow channel of which one end is connected to the first gas chamber; a first gas storage unit which is connected to the other end of the first gas flow channel; a first gas flow channel switching device which opens and closes to connect and disconnect the first gas chamber and the first gas storage unit to and from each other; a first atmosphere connection channel of which one end is connected to the first gas storage unit and the other end is connected to atmosphere; a first atmosphere connection channel switching device which opens and closes to connect and disconnect the first gas storage unit to and from the atmosphere; a first switching controlling device which controls operations of the first gas flow channel switching device and the first atmosphere connection channel switching device during initial position adjustment of the first partition and during pressurization of the liquid ejection head; and a first pressure controlling device which controls an operation of the first pressure applying device in response to the operations of the first gas flow channel switching device and the first atmosphere connection channel switching device controlled by the first switching controlling device.

The liquid ejecting apparatus includes an inkjet recording apparatus in which ink is ejected from an inkjet head to form an image on a recording medium.

Preferably, the liquid ejecting apparatus further comprising: a recovery flow channel which is connected to the liquid ejection head; a second pressure applying device which applies pressure to the liquid inside the recovery flow channel; a second pressure buffering unit including a second liquid chamber which is connected to the recovery flow channel, a second gas chamber which stores a gas, and a second partition which separates the second liquid chamber and the second gas chamber from each other, the second partition being deformable or movable so as to vary a volume of the second liquid chamber; a second gas flow channel of which one end is connected to the second gas chamber; a second gas storage unit which is connected to the other end of the second gas flow channel; a second gas flow channel switching device which opens and closes to connect and disconnect the second gas chamber and the second gas storage unit to and from each other; a second atmosphere connection channel of which one end is connected to the second gas storage unit and the other end is connected to the atmosphere; a second atmosphere connection channel switching device which opens and closes to connect and disconnect the second gas storage unit to and from the atmosphere; a second switching controlling device which controls operations of the second gas flow channel switching device and the second atmosphere connection channel switching device during recycling in which the liquid is recycled from the liquid ejection head through the recovery flow channel, during initial position adjustment of the second partition, and during pressurization of the liquid ejection head; and a second pressure controlling device which controls an operation of the second pressure applying device in response to the operations of the second gas flow channel switching device and the second atmosphere connection channel switching device controlled by the second switching controlling device.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

<General Configuration of Non-Recycling Ink Supplying Apparatus>

Figure 1:
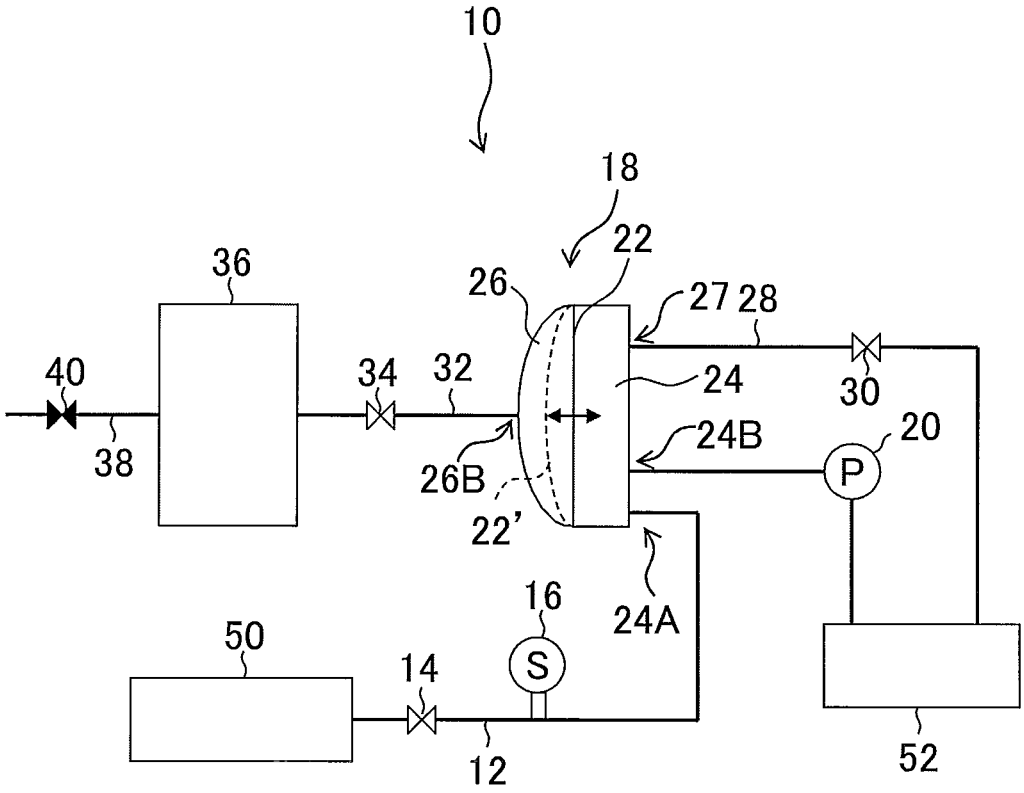
FIG. 1 is a block diagram showing a schematic configuration of a non-recycling ink supplying apparatus according to a first embodiment of the present invention.

FIG. 1 is a block diagram showing a general configuration of an ink supplying apparatus according to a first embodiment of the present invention. The ink supplying apparatus 10 shown in FIG. 1 is a non-recycling ink supplying apparatus which supplies ink to an inkjet head 50 (hereinafter also referred to simply as the "head"), which is a liquid supply target, from an ink tank 52 while controlling an internal pressure (back-pressure) of the head 50 by a feed amount of the ink.

As shown in FIG. 1, the ink supplying apparatus 10 includes: a supply flow channel 12, which is connected to the head 50; a supply valve 14, which is configured to connect and disconnect the liquid flow channel 12 to the head 50; a pressure sensor 16, which measures an internal pressure of the liquid flow channel 12; a supply sub-tank 18, which is configured to adjust pressure so as to suppress fluctuations in the internal pressure of the supply flow channel 12; and a supply pump 20, which is connected to the supply sub-tank 18 on an opposite side to the head 50 (i.e., connected to the supply flow channel 12 between the supply sub-tank 18 and an ink tank 52).

As the supply valve 14, a magnetic valve of normally-open type (or latched type) is applied, in which opening and closing is controlled by control signals. The pressure sensor 16 converts the internal pressure of the supply flow channel 12 into an electric signal and outputs the electric signal. Applicable sensors as the pressure sensor 16 include a semiconductor piezoelectric resistance sensor, a capacitance sensor, and a silicon resonant sensor. By opening the supply valve 14 and actuating the supply pump 20 to perform a forward operation, ink in the ink tank 52 is made to flow to the head 50 through the supply sub tank 18 and the supply flow channel 12.

Figure 2:
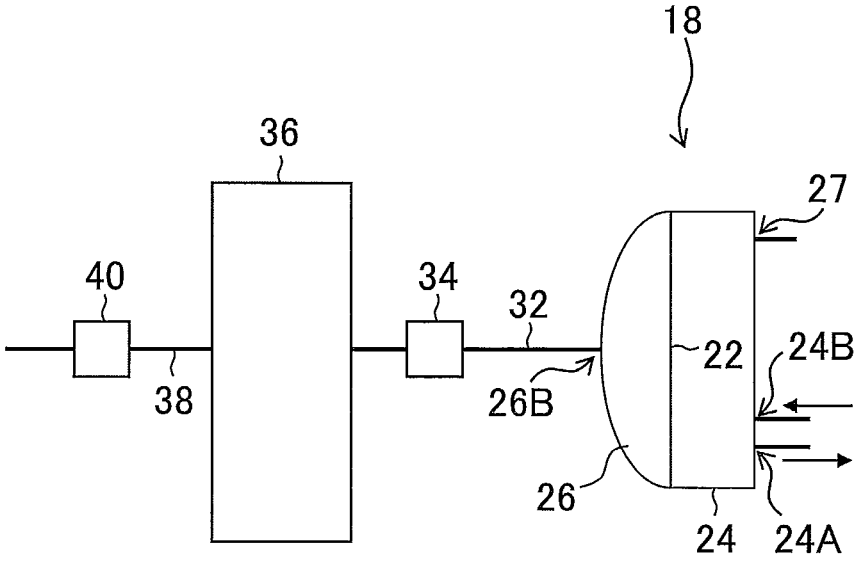
FIG. 2 is a block diagram showing a configuration of a pressure buffering unit applied to the ink supplying apparatus shown in FIG. 1.

FIG. 2 is a block diagram showing a configuration of a pressure buffering unit in the ink supplying apparatus 10 shown in FIG. 1. The pressure buffering unit shown in FIG. 2 includes the supply sub tank 18 and an air tank 36 configured to be connectable with a gas chamber 26 of the supply sub tank 18. The supply sub tank 18 has a structure in which a flexible elastic membrane 22 separates a liquid chamber 24 and the gas chamber 26 from each other, and an ink outlet 24A of the liquid chamber 24 is connected to the head 50 through the supply flow channel 12 and the supply valve 14 while an ink inlet 24B is connected to the ink tank 52 through the supply pump 20 (see FIG. 1). Moreover, the liquid chamber 24 is connected to the ink tank 52 through a drain flow channel 28 and a drain valve 30 (see FIG. 1).

As the ink flows into the liquid chamber 24 from the ink inlet 24B, the elastic membrane 22 deforms to a side of the gas chamber 26 in correspondence with a volume of the ink that has flowed in. On the other hand, since a volume of the ink flowing out from the ink outlet 24A does not fluctuate, even if a pressure fluctuation occurs in the supply flow channel 12, the pressure fluctuation is suppressed by an action of the supply sub tank 18.

More specifically, the supply sub tank 18 has a pressure buffering function which suppresses an internal pressure fluctuation of the head 50 and a fluctuation in the internal pressure of the supply flow channel 12 due to a pulsating flow caused by an operation of the supply pump 20. The drain flow channel 28, which is connected to the liquid chamber 24 through a bubble discharge port 27, is a flow channel for forcibly discharging the ink inside the liquid chamber 24. When the drain valve 30 shown in FIG. 1 is opened, the ink inside the liquid chamber 24 is sent to the ink tank 52 through a predetermined flow channel.

The gas chamber 26 is connected to the air tank 36 through an air flow channel 32 and an air connection valve 34. The air tank 36 is configured to be connectable to the atmosphere through an air valve 40 arranged in an atmosphere connection channel 38. By opening the air connection valve 34, the gas chamber 26 can be connected to the air tank 36 to increase a capacity of the gas chamber 26 in accordance with the ink feed pressure control. Moreover, by opening the air valve 40, the air tank 36 and the gas chamber 26 can be connected with the atmosphere.

The air tank 36, which functions as a buffer tank for the gas chamber 26, has a volume equivalent to three times a maximum volume of the gas chamber 26. In this case, a "maximum volume of gas chamber 26" is a volume of the gas chamber 26 in a state in which the elastic membrane 22 is at an initial position (to be described in detail later). By providing the air tank 36 with a large volume, a capacity can be increased when a high pressure is required such as when executing pressurizing purge of the inkjet head. Moreover, from the perspective of the pressure buffering function, the greater the volume of the gas chamber 26, the better. However, since there is a limit to how much the elastic membrane 22 deforms, the volume of the gas chamber 26 is restricted by the deformable amount of the elastic membrane 22.

The air tank 36 is provided in addition to the gas chamber 26 to ensure that the adjustment of the position of the elastic membrane 22 is stably performed and to prevent the elastic membrane 22 from being subjected to excessive stress. The volume of the air tank 36 just needs to exceed the maximum volume of the gas chamber 26 and, favorably, equals or exceeds three times the maximum volume of the gas chamber 26. On the other hand, providing the air tank 36 with an excessively large volume impairs responsiveness during pressure control. Therefore, there is an optimal value of a total amount of the volume of the gas chamber 26 and the volume of the air tank 36.

A configuration is adopted in which a normally-open magnetic valve is applied as the air connection valve 34 and a normally-closed magnetic valve is applied as the air valve 40 in order to ensure that the ink does not leak out from the head 50 even if power is cut off due to activation of an emergency stop function or the like.

Figure 3:
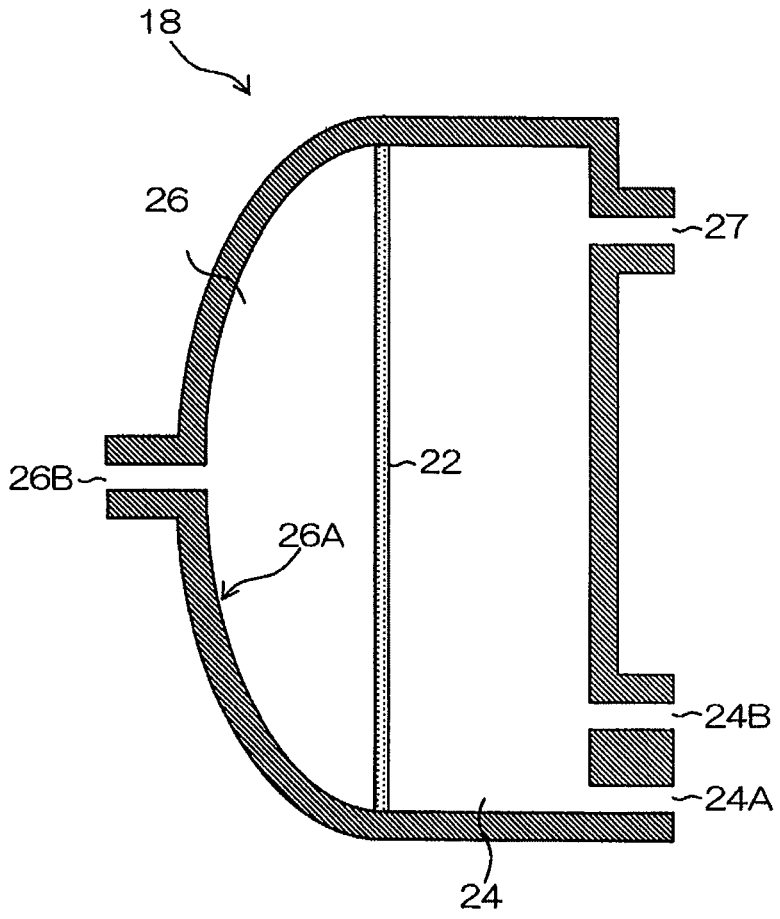
FIG. 3 is a cross-sectional view showing a structure of a sub tank applied to the pressure buffering unit shown in FIG. 2.

FIG. 3 is a cross-sectional view showing a structure of the supply sub tank 18 in the present embodiment. As shown in FIG. 3, in the supply sub tank 18, an interior of a sealed container is partitioned with the elastic membrane 22, whereby one side of the elastic membrane 22 is assumed to be the liquid chamber 24 and another side is assumed to be the gas chamber 26. As the ink flows in from the ink inlet 24B, the elastic membrane 22 deforms to the side of the gas chamber 26 as the pressure (the ink feed amount) in the liquid chamber 24 and the pressure in the gas chamber 26 come to equilibrium. Due to such a structure, the supply sub tank 18 functions as the damper even if a pressure fluctuation occurs in the supply flow channel 12. In addition, the ink outlet 24A and the ink inlet 24B are arranged on a face of the liquid chamber 24 on the side opposite to the elastic membrane 22 and have a structure in which the ink is supplied upward from below. Furthermore, the bubble discharge port 27 for discharging bubbles accumulated in the liquid chamber 24 is arranged on the face of the liquid chamber 24 on the side opposite to the elastic membrane 22. The liquid chamber 24 is connected to the drain flow channel 28 through the bubble discharge port 27. Since bubbles are more likely to escape from the upper part, the bubble discharge port 27 is arranged at the uppermost part, while the ink outlet 24A is arranged at the lowermost part in order to prevent bubbles from flowing to the head.

The gas chamber 26 of the supply sub tank 18 shown in FIG. 3 has a bowl (domed) shape in which an opposing face 26A which opposes the elastic membrane 22 is constituted of a curved surface. Therefore, even if the elastic membrane 22 deforms and comes into contact with the opposing face 26A, since no corners impact the elastic membrane 22 to break the elastic membrane 22, durability of the elastic membrane 22 is secured. An air flow channel connection port 26B, which is connected to the air flow channel 32 (see FIG. 2), is formed on a wall that constitutes the opposing face 26A of the gas chamber 26.

<Configuration of Control System>

Figure 4:
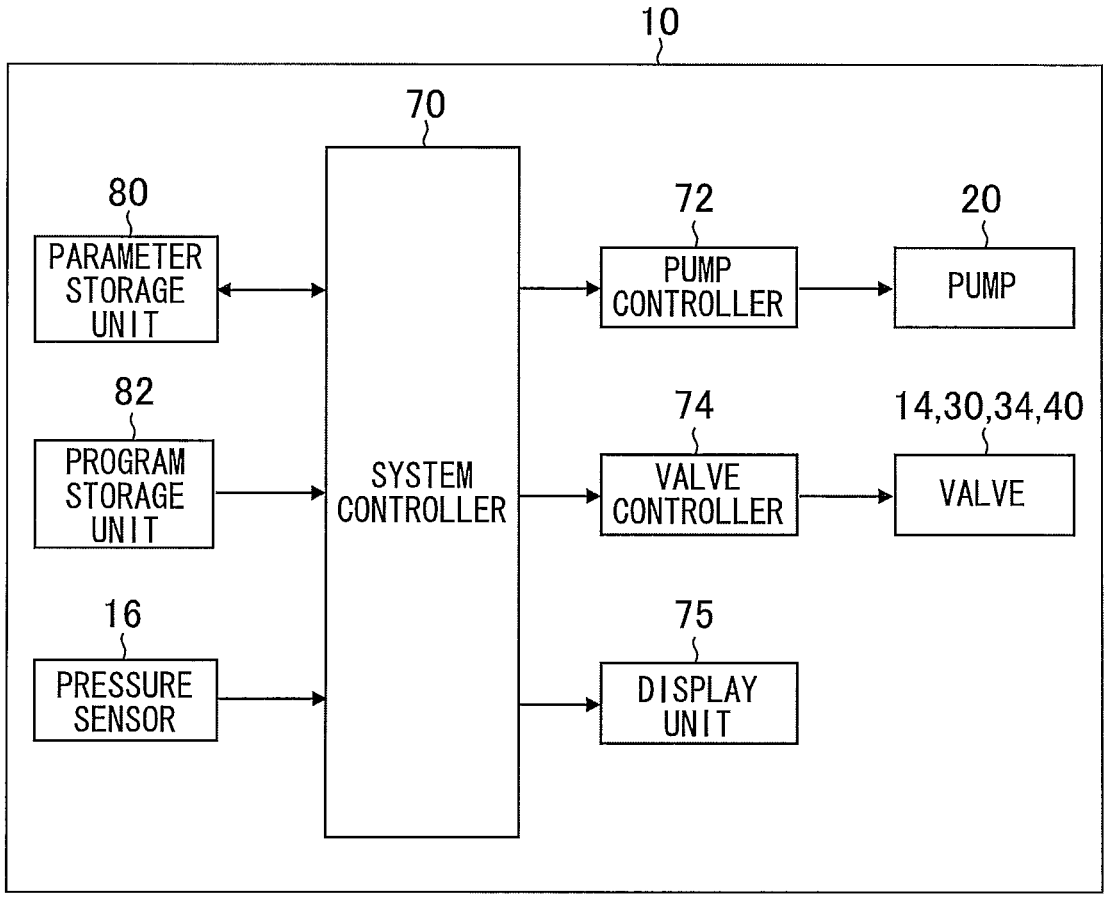
FIG. 4 is a block diagram showing a configuration of a controller applied to the ink supplying apparatus shown in FIG. 1.

FIG. 4 is a block diagram showing a schematic configuration of a control system of the ink supplying apparatus 10 according to the present embodiment. The ink supplying apparatus 10 in FIG. 4 includes: a system controller 70, which integrally controls the control system; a pump controller 72, which controls the supply pump 20 in accordance with control signals sent from the system controller 70; a valve controller 74, which controls opening and closing of the valves such as the supply valve 14, the drain valve 30, the air connection valve 34 and the air valve 40; and a display unit 75 which, upon an occurrence of a failure at respective parts of the apparatus, issues a notification to that effect.

A parameter storage unit 80 shown in FIG. 4 stores parameters used to control the ink supplying apparatus 10 and data tables to be referenced during the control. For example, the data tables stored in the parameter storage unit 80 includes the data table indicating a relationship between the volume of the liquid chamber 24 and the measured pressure value for the liquid flow channel, which will be described later.

A program storage unit 82 stores programs used to control the ink supplying apparatus 10. The system controller 70 integrally controls the ink supplying apparatus 10 by reading out and executing the control programs stored in the program storage unit 82 and by referencing the parameters and the data tables stored in the parameter storage unit 80.

The ink supplying apparatus 10 according to the present embodiment controls operations of the valves including the supply valve 14, and controls operations of the supply pump 20 in accordance with information on the pressure inside the supply flow channel 12, which is obtained from the pressure sensor 16. The pressure information (a pressure increase to be described later) obtained from the pressure sensor 16 is sequentially written into a predetermined memory and updated.

Moreover, the ink supplying apparatus 10 according to the present embodiment includes a timer (not shown) and measures an elapsed time from a pressure control switching timing and an elapsed time from an opening or closing of a valve, and measurement results are sequentially written into a memory (not shown).

Next, a configuration according to an embodiment of the present invention in which the non-recycling ink supplying apparatus 10 is applied as an ink supplying apparatus of a multi-nozzle inkjet head is described. In the configuration shown in FIG. 5, the ink is supplied from a non-recycling ink supplying apparatus 10' to an inkjet head 50'. Parts in FIG. 5 which are the same as or similar to the parts shown in FIG. 1 are denoted with the same reference numerals, and description thereof is omitted.

Figure 5:
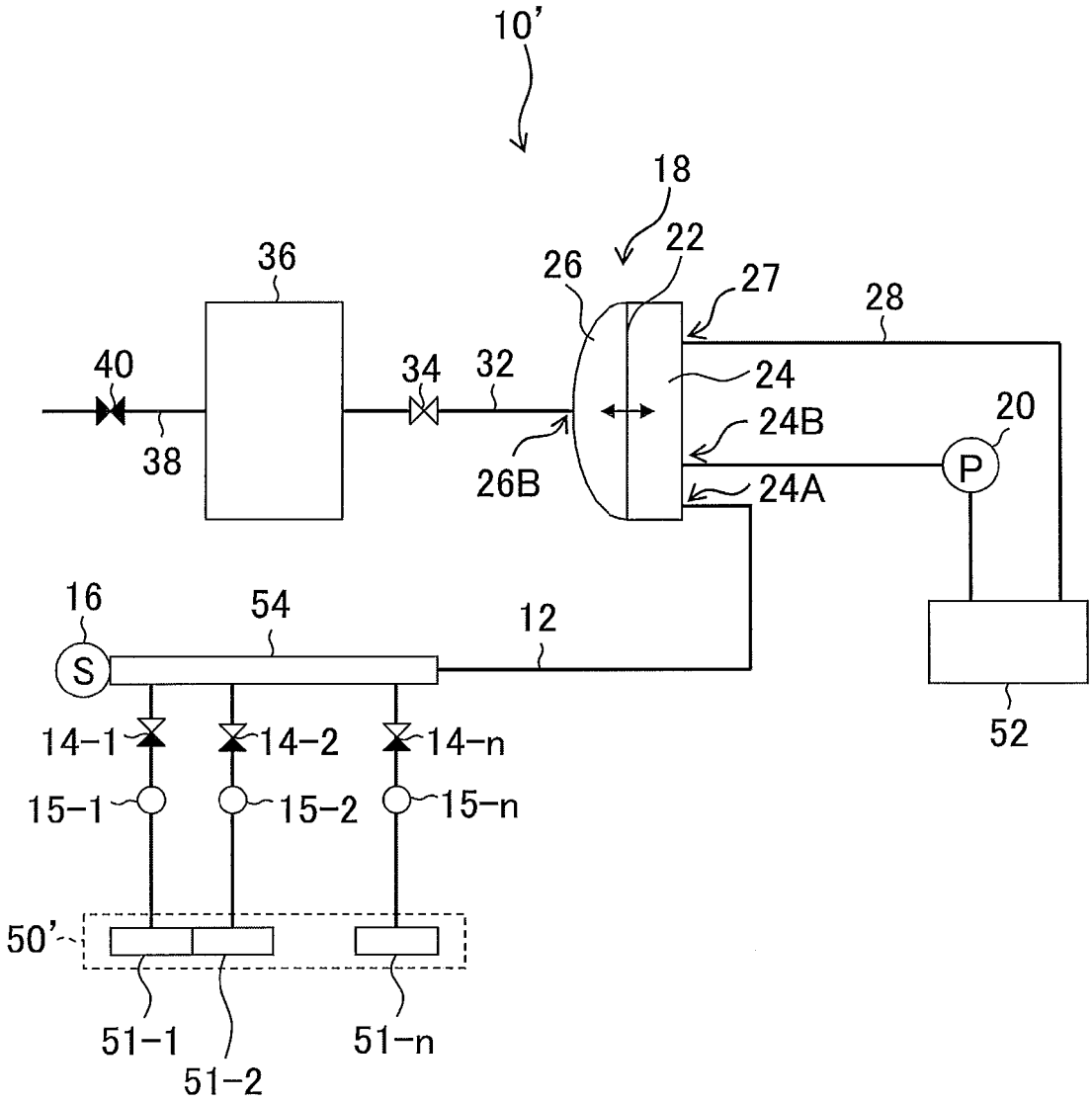
FIG. 5 is a block diagram showing a configuration in which the ink supplying apparatus shown in FIG. 1 is applied as an ink supplying apparatus of an inkjet head.

The inkjet head 50' shown in FIG. 5 is composed by joining together n head modules 51-1, 51-2, . . . , **51-*n*. The ink is supplied to the head modules 51-1 to 51-*n* constituting the head 50' through flow channels individually branched in correspondence to the head modules 51-1 to 51-*n* from a supply manifold 54, which is connected to the supply flow channel 12. Supply valves 14-1, 14-2, . . . , 14-*n* and dampers 15-1, 15-2, . . . , 15-*n*** are respectively arranged in the individual flow channels.

In the ink supplying apparatuses 10 and 10' described above, opening and closing of the supply valve 14, the air connection valve 34 and the air valve 40 are controlled and switching of rotational directions of the supply pump 20 is performed during position initialization (during initial position adjustment) of the elastic membrane 22 arranged in the supply sub tank 18 and during pressurizing purge of the head 50 (50'). Next, the control of the supply valve 14, the air connection valve 34 and the air valve 40, and the control of the supply pump 20 are described in detail.

<Initial Position Adjustment of Elastic Membrane>

Figure 6:
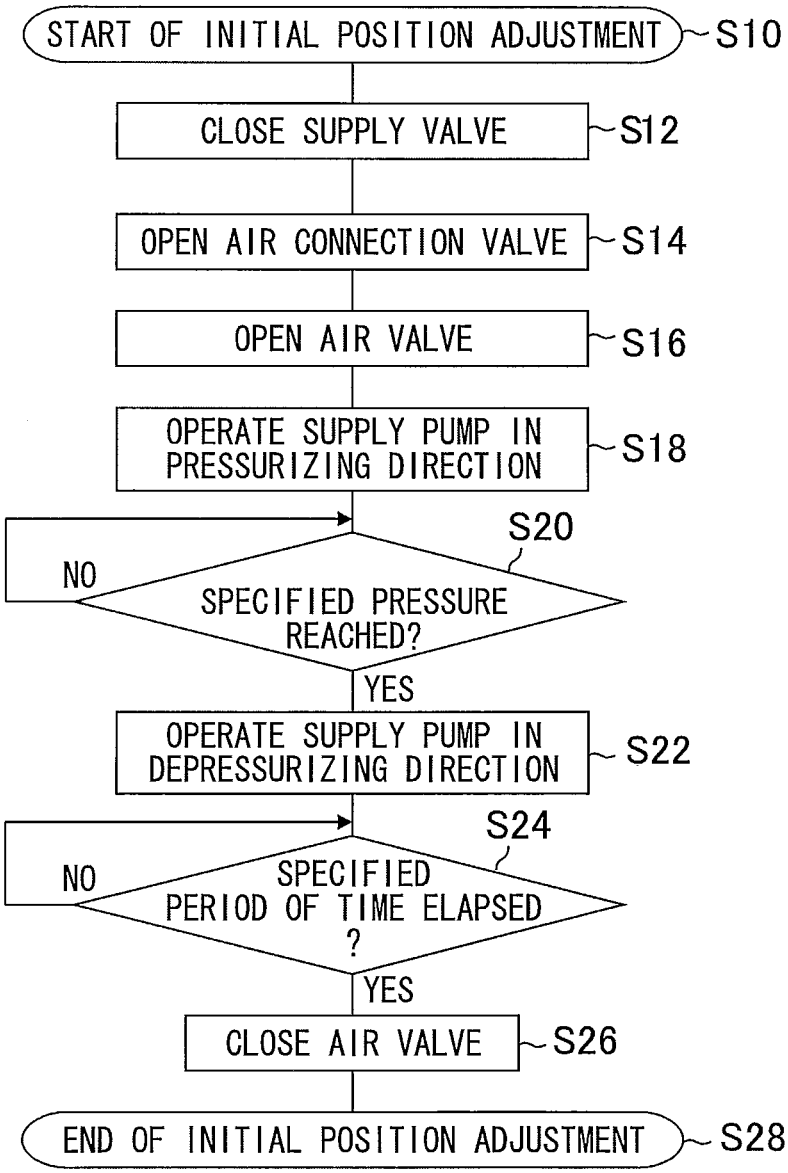
FIG. 6 is a flow chart showing a flow of control of an initial position adjustment of an elastic membrane shown in FIG. 1.

FIG. 6 is a flow chart showing a flow of the control of the initial position adjustment of the elastic membrane 22. In the supply sub tank 18 according to the present embodiment (shown in FIGS. 1 to 3), a deformation amount (position) of the elastic membrane 22 varies over time, and once the position of the elastic membrane 22 changes, a variance occurs in the pressure control of the supply flow channel 12. Therefore, the initial position adjustment of the elastic membrane 22 is executed as appropriate to avoid a variance in the pressure control of the supply flow channel 12. Timings of executing the initial position adjustment of the elastic membrane 22 include, for example, upon activation of the ink supplying apparatus 10, after executing pressurizing purge, and when the pressure inside the supply flow channel 12 changes significantly due to an abnormality of the supply pump 20, or the like.

As shown in FIG. 6, when an initial position adjustment of the elastic membrane 22 is started (step S10), the supply valve 14 is closed (step S12) to place the supply flow channel 12 and the head 50 in a disconnection state. Subsequently, the air connection valve 34 is opened (step S14), and the air valve 40 is opened (step S16), so that the gas chamber 26 and the air tank 36 are connected to each other, and the gas chamber 26 and the air tank 36 are opened to the atmosphere. In this state, the supply pump 20 is actuated to perform the forward operation to send the ink into the liquid chamber 24 to pressurize the interior of the liquid chamber 24 (step S18), and the pressure measured by the pressure sensor 16 is monitored.

In step S20, the monitoring is performed as to whether or not the pressure measured by the pressure sensor 16 reaches a specified pressure. When the pressure measured by the pressure sensor 16 has not reached the specified pressure (No verdict), the pressurization and the pressure monitoring are continued. On the other hand, when the pressure measured by the pressure sensor 16 reaches the specified pressure (Yes verdict), the rotational direction of the supply pump 20 is switched to the depressurizing direction (step S22). In this case, the "specified pressure" means a predetermined pressure within a range in which the volume of the liquid chamber 24 and the pressure maintain a proportional relationship.

Figure 7A:
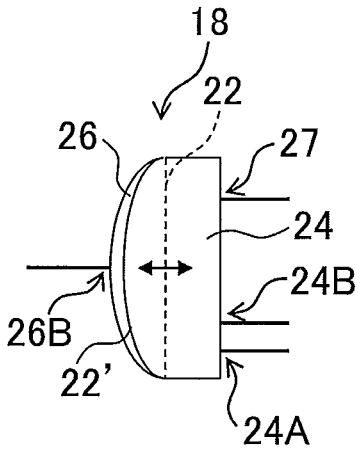
FIGS. 7A and 7B are diagrams illustrating deformed states of the elastic membrane during the initial position adjustment of the elastic membrane shown in FIG. 1.

FIG. 7A schematically illustrates the supply sub tank 18 in a state in which the specified pressure has been reached. As shown in FIG. 7A, when the interior of the liquid chamber 24 is pressurized, the elastic membrane 22 deforms to the side of the gas chamber 26 (the elastic membrane 22 at the initial position is depicted with a dashed line), whereby a deformation amount increases over time, and a state is reached that is depicted with a solid line denoted with reference numeral 22'.

From the state illustrated in FIG. 7A in which the specified pressure has been reached, by actuating the supply pump 20 to perform the depressurizing operation at a constant speed to cause the ink to be discharged from the liquid chamber 24 by a constant amount per unit time, the elastic membrane 22 deforms to the side of the liquid chamber 24, where the deformation amount of the elastic membrane 22 is proportional to the discharge amount of ink.

Referring back to FIG. 6, an elapsed time from the start of the depressurizing operation is monitored in step S24, and when a predetermined period of time has not elapsed from the start of the depressurizing operation (No verdict), the depressurizing operation of the supply pump 20 and the monitoring of the elapsed time are continued. On the other hand, when the predetermined period of time has elapsed from the start of the depressurization operation (Yes verdict), the air valve 40 is closed (step S26). More specifically, when a predetermined amount of ink is discharged from the state of the liquid chamber 24 that is depicted with the solid line denoted with reference numeral 22' in FIG. 7A, the elastic membrane 22 deforms by a predetermined amount in a direction which causes the liquid chamber 24 to contract in correspondence to a discharge amount of the ink and is adjusted to a determined initial position. Subsequently, the gas chamber 26 and the air tank 36 are disconnected from the atmosphere while maintaining the connection to each other, and the initial position adjustment of the elastic membrane 22 is finished (step S28).

Figure 7B:
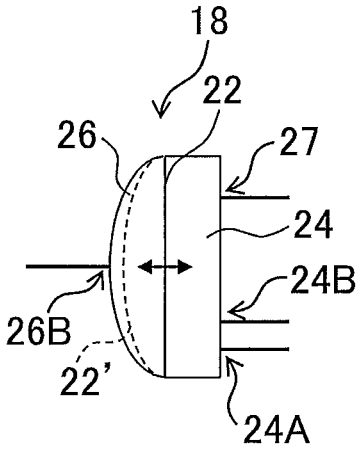

FIG. 7B schematically illustrates a state of the supply sub tank 18 when the liquid chamber 24 is depressurized from the state of the specified pressure and a predetermined period of time has elapsed from the start of the depressurizing operation. In FIG. 7B, the elastic membrane at the position in the state of the specified pressure is depicted with a dashed line denoted with reference numeral 22', and the elastic membrane at the initial position is depicted with a solid line denoted with reference numeral 22.

Figure 8:
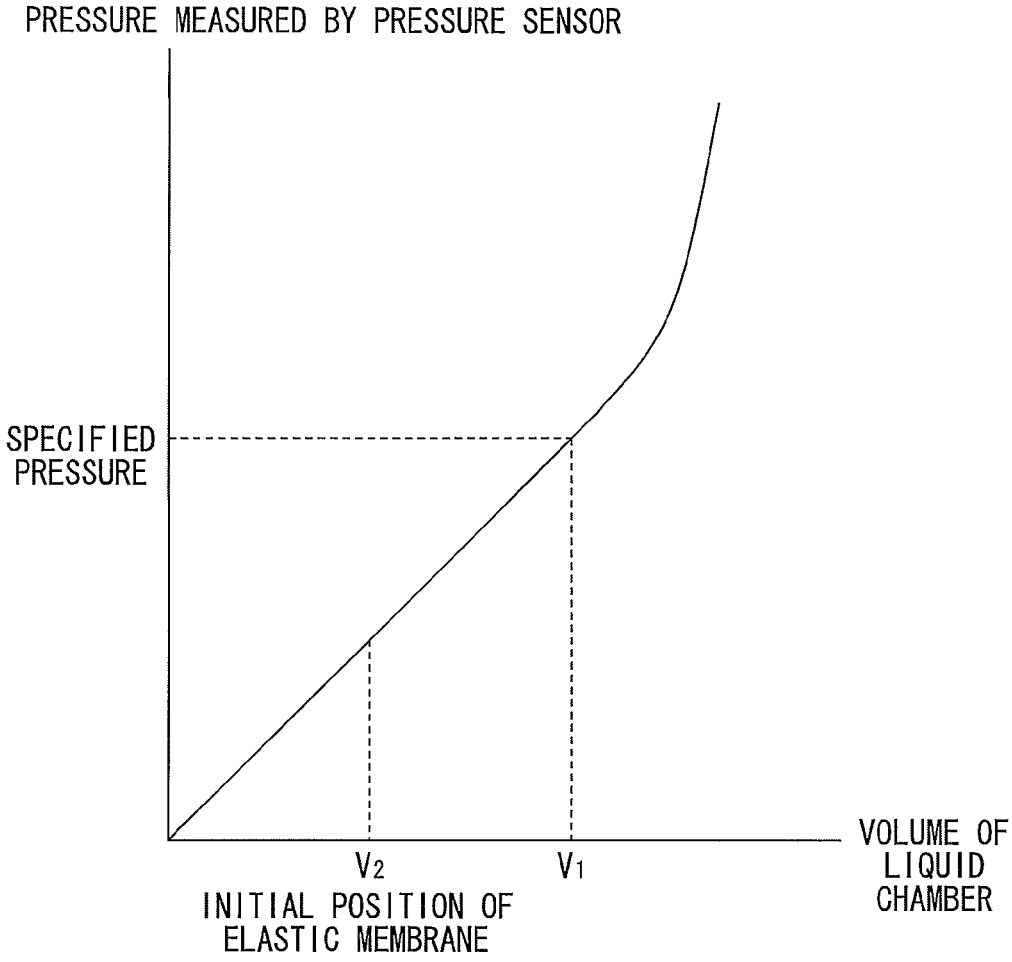
FIG. 8 is a diagram illustrating a relationship between a volume of a liquid chamber and pressure measured by a pressure sensor shown in FIG. 1.

FIG. 8 is a graph showing a relationship between the volume (amount of inflow of the ink) of the liquid chamber 24 and the pressure measured by the pressure sensor 16 (shown in FIG. 1). The pressure measured by the pressure sensor 16 shown in FIG. 8 is equivalent to the internal pressure of the liquid chamber 24. As shown in FIG. 8, the internal pressure of the liquid chamber 24, which is determined as the pressure measured by the pressure sensor 16, is proportional to the volume of ink that flows into the liquid chamber 24 while the elastic membrane 22 is within an elastic region (i.e., a region in which the elastic membrane 22 is elastically deformable). On the other hand, as the volume of the liquid chamber 24 increases beyond the elastic region of the elastic membrane 22, the proportional relationship between the internal pressure of the liquid chamber 24 and the ink inflow volume is no longer satisfied due to the membrane 22, and once the volume of the liquid chamber 24 reaches maximum, the internal pressure of the liquid chamber 24 rises abruptly. There may be cases in which the volume of the liquid chamber 24 reaches maximum while the elastic membrane 22 is within the elastic region.

By determining a relationship between the internal pressure of the liquid chamber 24 and the volume of the liquid chamber 24 in advance and storing the relationship in the predetermined memory, the volume of the liquid chamber 24 can be estimated by referring to the memory when the internal pressure of the liquid chamber 24 is determined from the pressure measured by the pressure sensor 16. The volume $V_1$ of the liquid chamber 24 corresponding to the specified pressure shown in FIG. 8 corresponds to the state of the specified pressure of the liquid chamber 24 (shown in FIG. 7A).

When discharging the ink at a constant flow rate from the liquid chamber 24, the volume of the ink flowed out from the liquid chamber 24 can be calculated by multiplying the discharge amount per unit time by the discharge period. Therefore, the volume of the ink discharged from the liquid chamber 24 can be determined from the duration of the reverse operation (depressurizing operation) performed by the supply pump 20 at a certain number of revolutions. The volume $V_2$ of the liquid chamber 24 shown in FIG. 8 indicates the volume of the liquid chamber 24 when the position of the elastic membrane 22 is adjusted to the initial position.

In this manner, by executing the initial position adjustment of the elastic membrane 22 as appropriate, the variance in the pressure control over time can be avoided and stable liquid supply is realized.

<Pressurizing Purge>

Next, a description is given on control of the supply valve 14, the air connection valve 34, and the air valve 40, as well as control of the supply pump 20 during an execution of a pressurizing purge in which the internal pressure of the head 50 (shown in FIG. 1) is set to a positive pressure and the ink inside the head 50 is forcibly discharged from the nozzle.

Figure 9:
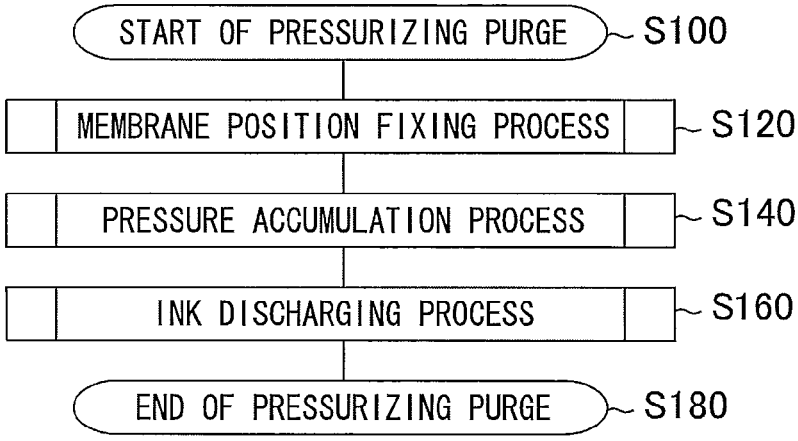
FIG. 9 is a flow chart showing a flow of control of pressurizing purge.

FIG. 9 is a flow chart showing a flow of control of pressurizing purge. As shown in FIG. 9, the pressurizing purge includes a membrane position fixing process (step S120), a pressure accumulation process (step S140), and an ink discharging process (step S160).

Figure 10:
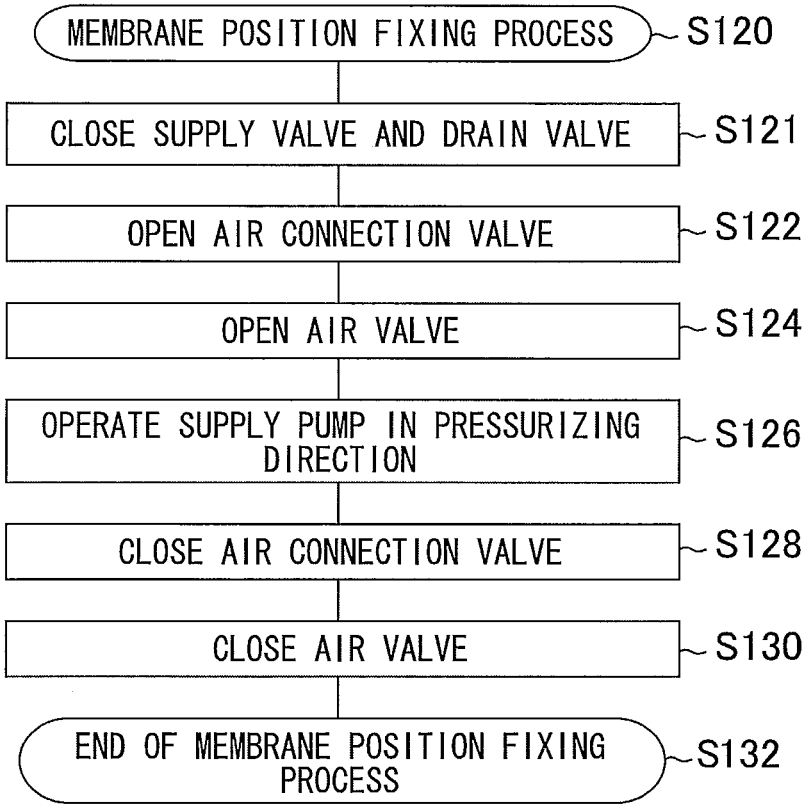
FIG. 10 is a flow chart showing a flow of control of a membrane position fixing process in the pressurizing purge control shown in FIG. 9.

FIG. 10 is a flow chart of the membrane position fixing process (step S120). The membrane position fixing process is a process in which the elastic membrane 22 is deformed to a state where the elastic membrane 22 is stuck on the opposing face 26A of the gas chamber 26. When the membrane position fixing process is started, the supply valve 14 and the drain valve 30 are closed (step S121), the air connection valve 34 is opened (step S122), the air valve 40 is opened (step S124), and the gas chamber 26 and the air tank 36 are connected to each other and also to the atmosphere. In this state, the supply pump 20 is actuated to perform the forward operation to pressurize the interior of the liquid chamber 24 and to realize a state in which the elastic membrane 22 is stuck on the opposing face 26A of the gas chamber 26 (step S126).

Once the state is reached in which the elastic membrane 22 is stuck on the opposing face 26A of the gas chamber 26, the air connection valve 34 is closed (step S128), the air valve 40 is closed (step S130), and the membrane position fixing process is finished (step S132). Due to the membrane position fixing process, the elastic membrane 22 is fixed in the state in which the elastic membrane 22 is stuck on the opposing face 26A of the gas chamber 26, the gas chamber 26 and the air tank 36 are placed in the disconnected state, and the gas chamber 26 is also disconnected from the atmosphere.

Figure 11:
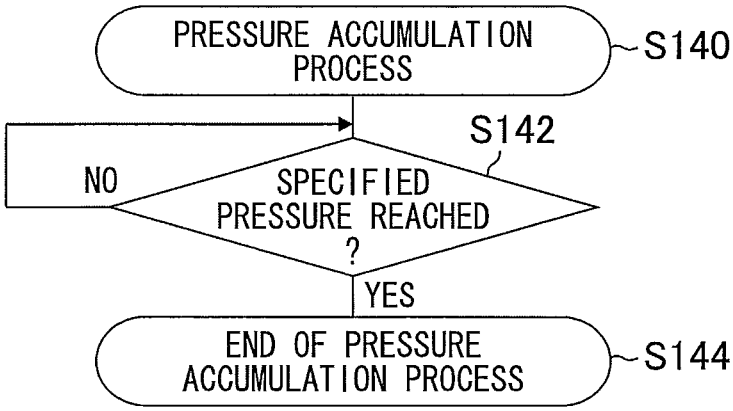
FIG. 11 is a flow chart showing a flow of control of a pressure accumulation process in the pressurizing purge control shown in FIG. 9.

FIG. 11 is a flow chart of the pressure accumulation process. The pressure accumulation process is started when the elastic membrane 22 is fixed in the state in which the elastic membrane 22 is stuck on the opposing face 26A of the gas chamber 26 by the membrane position fixing process shown in FIG. 10. The pressure accumulation process is a process in which the ink is filled into the liquid chamber 24 that is in the state of maximum volume, to accumulate pressure required to the purge in the supply sub tank 18 (and the supply flow channel 12). More specifically, in the pressure accumulation process, in the state in which the supply valve 14 is closed, the liquid chamber 24 is pressurized while monitoring the pressure measured by the pressure sensor 16, and the pressurization is continued until the pressure measured by the pressure sensor 16 assumes a specified pressure (step S142). Once the pressure measured by the pressure sensor 16 reaches the specified pressure, the liquid chamber 24 and the supply flow channel 12 become filled with the ink, the predetermined pressure is accumulated in the supply sub tank 18 and the supply flow channel 12, and the pressure accumulation process is finished (step S144).

Figure 12:
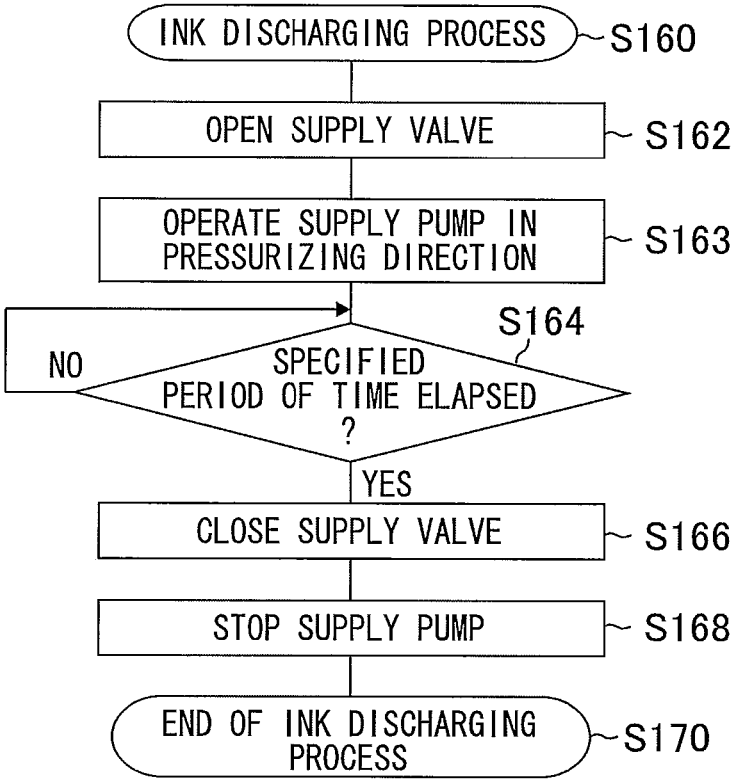
FIG. 12 is a flow chart showing a flow of control of an ink discharging process in the pressurizing purge control shown in FIG. 9.

FIG. 12 is a flow chart of the ink discharging process. The ink discharging process is a process in which the ink is discharged (purged) from the nozzle of the head 50 using the pressure accumulated in the pressure accumulation process. First, the supply valve 14 is opened (step S162). Consequently, due to the ink stored in the pressure accumulation process flowing into the head 50, the internal pressure of the head 50 becomes a positive pressure and the ink is discharged from the head 50. At this point, the supply pump 20 is operated in the pressurizing direction in order to prevent the internal pressure of the head 50 from dropping (step S163).

When the discharge of the ink is started, an elapsed time from the opening of the supply valve 14 is monitored (step S164). When a predetermined period of time has elapsed (Yes verdict), the supply valve 14 is closed (step S166), the supply pump 20 is stopped (step S168), and the ink discharging process is finished (step S170). Once the pressurizing purge shown in FIGS. 9 to 12 is finished, the valve control and the pump control transition to predetermined states.

When executing the pressurizing purge, the elastic membrane 22 is fixed in the state in which the capacity of the liquid chamber 24 becomes maximum (the state in which pressure loss due to the pressure buffering does not occur), and the pressure is accumulated in the supply sub tank 18 and the supply flow channel 12 in this state. Accordingly, effects may be gained such as a reduction in a period of time required to accumulate the pressure in the supply sub tank 18, a sharp pressure wave of the pressurizing purge is obtained (pressurization characteristics caused by the sharp pressure curve can be obtained), and bubbles and foreign objects may be more easily removed.

According to the ink supplying apparatus 10 configured as described above, since the initial position of the elastic membrane 22, which separates the liquid chamber 24 and the gas chamber 26 from each other in the supply sub tank 18, is adjusted as appropriate, a deformation amount (position) of the elastic membrane 22 does not vary over time and a variance in the pressure control is avoided.

Moreover, in the pressurizing purge, since the elastic membrane 22 is fixed in the state in which the capacity of the liquid chamber 24 becomes maximum and the pressure is accumulated in the supply sub tank 18 and the supply flow channel 12, effects may be gained such as the reduction in a period of time required to accumulate the pressure in the supply sub tank 18, a sharp pressure wave of the pressurizing purge is obtained, and bubbles and foreign objects may be more easily removed.

Second Embodiment

Next, an ink supplying apparatus according to a second embodiment of the present invention is described. The ink supplying apparatus 100 shown in FIG. 13 differs from the non-recycling ink supplying apparatus 10 shown in FIG. 1 in that the ink supplying apparatus 100 is a recycling ink supplying apparatus including a recycling system. The following description is mainly focus on components which differ from the ink supplying apparatus 10 in the first embodiment described above.

<General Configuration of Recycling Ink Supplying Apparatus>

Figure 13:
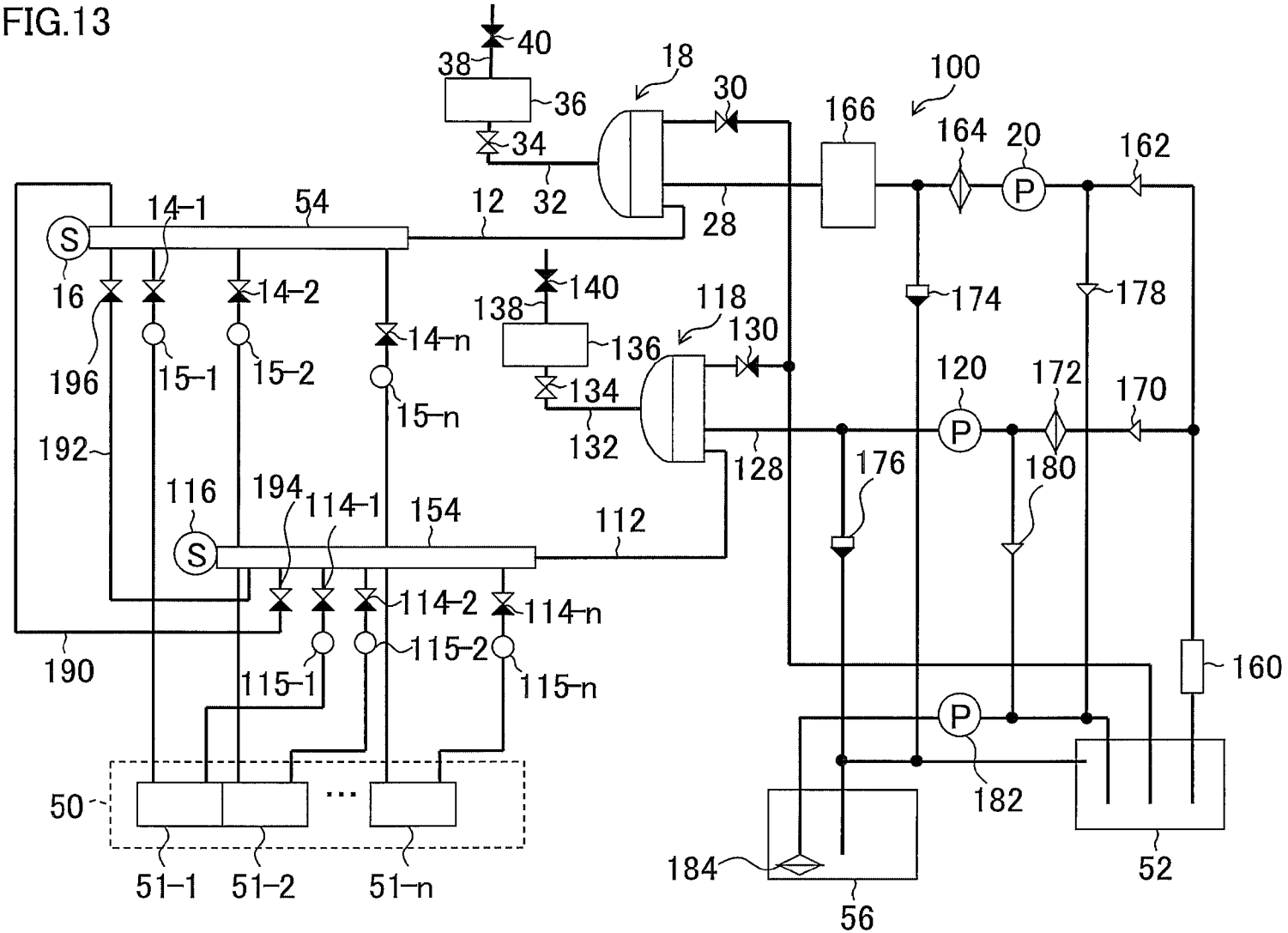
FIG. 13 is a block diagram showing a schematic configuration of a recycling ink supplying apparatus according to a second embodiment of the present invention.

The ink supplying apparatus 100 shown in FIG. 13 includes the supply flow channel 12 and a recovery flow channel 112, wherein a supply flow channel pressure sensor 16 (corresponding to the pressure sensor 16 shown in FIG. 1) is arranged in the supply flow channel 12, and a recovery flow channel pressure sensor 116 is arranged in the recovery flow channel 112. Moreover, the supply sub tank 18 is arranged at the supply flow channel 12, and a recovery sub tank 118 is arranged at the recovery flow channel 112. The supply sub tank 18 is connected to the ink tank 52 through the supply pump 20 and a predetermined ink flow channel, and the recovery sub tank 118 is connected to the ink tank 52 through a recovery pump 120 and a predetermined ink flow channel.

The head 50 shown in FIG. 13 is the head having the structure in which n head modules 51-1, 51-2, . . . , **51-*n* are joined together. Each of the head modules 51-1, 51-2, . . . , 51-*n* is connected to the supply flow channel 12 through the supply valves 14-1, 14-2, . . . , 14-*n* and the dampers 15-1, 15-2, . . . , 15-*n*, and also to the recovery flow channel 112 through dampers 115-1, 115-2, . . . , 115-*n* and recovery valves 114-1, 114-2, . . . , 114-*n***.

The supply manifold 54 and a recovery manifold 154 are ink temporary storage units respectively arranged between the supply flow channel 12 and the head 50, and between the head 50 and the recovery flow channel 112. The supply manifold 54 and the recovery manifold 154 are connected to each other through a first bypass flow channel 190 and a second bypass flow channel 192. A first bypass flow channel valve 194 and a second bypass flow channel valve 196 are respectively arranged in the first and second bypass flow channels 190 and 192.

Tube pumps are applied as the supply pump 20 and the recovery pump 120. The supply pump 20 shown in FIG. 13 controls the pressure (liquid feed amount) of the supply flow channel 12, which supplies the ink from the ink tank (buffer tank) 52 to the head 50, and the recovery pump 120 controls the pressure (liquid feed amount) of the recovery flow channel 112, which recovers (recycles) the ink from the head 50 to the ink tank 52. The pumps having the same performance (capacity) can be applied as the supply pump 20 and the recovery pump 120.

The supply pump 20 and the recovery pump 120 rotate only in one direction when the head 50 is not in operation (i.e., when the ink is flowing in a stable manner), and when the head 50 is in ejection operation and the internal pressure of the head 50 decreases, the supply pump 20 increases the rotational speed while the recovery pump 120 reverses the rotation to increase the internal pressure of the head 50.

Since the supply sub tank 18 and the recovery sub tank 118 share the same structure as the supply sub tank 18 shown in FIG. 3, a description is hereby omitted. Moreover, a drain flow channel 128, a drain valve 130, an air flow channel 132, an air connection valve 134, an air tank 136, an atmosphere connection channel 138, and an air valve 140 of the recycling system (recovery-side) shown in FIG. 13 respectively correspond to the drain flow channel 28, the drain valve 30, the air flow channel 32, the air connection valve 34, the air tank 36, the atmosphere connection channel 38, and the air valve 40 of the supplying system.

Furthermore, a latched magnetic valve is applied as the drain valve 130, a normally-open magnetic valve is applied as the air connection valve 134, and normally-closed magnetic valves are applied as the supply valves 14-1, 14-2, . . . , **14-*n*, the recovery valves 114-1, 114-2, . . . , 114-*n*, and the air valve 140**.

In the ink supplying apparatus 100 shown in FIG. 13, a deaeration module 160 and an one-way valve 162, which prevents the ink from flowing in reverse, are arranged between the ink tank 52 and the supply pump 20, and a filter 164 and a heat exchanger (cooling and heating device) 166 are arranged between the supply pump 20 and the supply sub tank 18. The ink sent from the ink tank 52 is subjected to deaeration by the deaeration module 160, removal of bubbles and foreign objects by the filter 164, and temperature adjustment by the heat exchanger 166 before being sent to the supply sub tank 18.

Moreover, a one-way valve 170, which prevents the ink from flowing in reverse, and a filter 172 are arranged between the deaeration module 160 and the recovery pump 120, and predetermined deaeration and filtering are also performed when the ink is sent from the ink tank 52 to the recovery sub tank 118.

Further, the ink supplying apparatus 100 is provided with safety valves (relief valves) 174 and 176. When an abnormality occurs at the supply pump 20 or the recovery pump 120 and the internal pressure of the supply flow channel 12 or the recovery flow channel 112 exceeds a predetermined value, the safety valve 174 or 176 is actuated to bring down the internal pressure of the supply flow channel 12 or the recovery flow channel 112. Furthermore, one-way valves 178 and 180 are also arranged which prevent the ink from flowing backward when the supply pump 20 and the recovery pump 120 are actuated to perform the reverse operations.

A main tank 56 shown in FIG. 13 stores the ink to be supplied to the buffer tank 52. When an amount of the ink in the buffer tank 52 decreases, a replenishment pump 182 is actuated to send the ink in the main tank 56 to the buffer tank 52. A filter 184 is arranged inside the main tank 56.

<Description of Recycling>

The ink supplying apparatus 100 having the configuration described above actuates the supply pump 20 and the recovery pump 120 to produce a differential pressure between the supply manifold 54 and the recovery manifold 154 in order to recycle the ink For example, in a state in which the supply valves 14-1, 14-2, . . . , **14-*n* and the recovery valves 114-1, 114-2, . . . , 114-*n* are opened, actuating the supply pump 20 to perform the forward operation and to generate negative pressure in the supply manifold 54 and, at the same time, actuating the recovery pump 120 to perform the reverse operation to generate negative pressure that is lower than the supply side in the recovery manifold 154 causes the ink to flow from the supply manifold 54 to the recovery manifold 154 through the head 50, and further enables the ink to be recycled through the recovery flow channel 112, the recovery sub tank 118**, and so on.

When recycling the ink, the second bypass flow channel valve 196 arranged in the second bypass flow channel 192 is opened to connect the supply manifold 54 and the recovery manifold 154 to each other through the second bypass flow channel 192. It is sufficient to arrange only one of the first and second bypass flow channels 190 and 192 if the one of the bypass flow channels has a diameter capable of preventing an occurrence of a pressure loss during pressurization.

<Initial Position Adjustment of Elastic Membrane>

In the ink supplying apparatus 100 shown in FIG. 13, since the supply valves 14-1, 14-2, . . . , **14-*n*, the air connection valve 34, the air valve 40 and the supply pump 20 on the supply side, and the recovery valves 114-1, 114-2, . . . , 114-*n*, the air connection valve 134, the air valve 140 and the recovery pump 120 on the recovery side, can be operated independently from each other, then the initial position adjustment of the elastic membrane 22 described with reference to FIGS. 6 to 8 can also be applied to the initial position adjustment of an elastic membrane of the recovery sub tank 118**.

<Pressurizing Purge>

Figure 14:
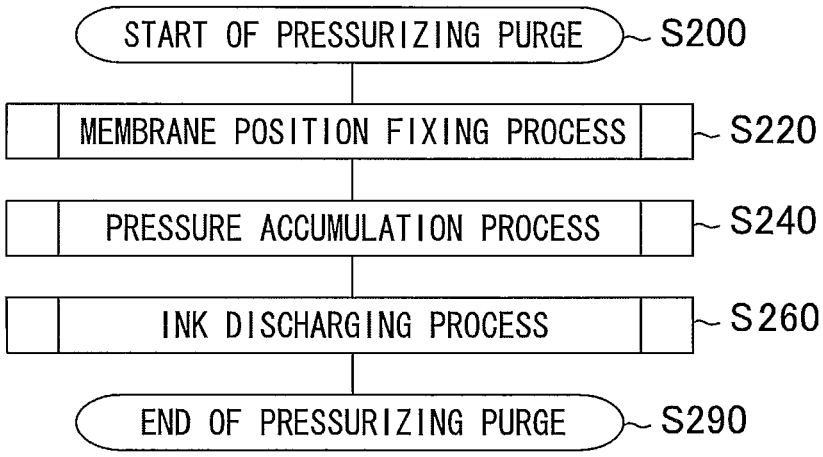
FIG. 14 is a flow chart showing a flow of control of pressurizing purge in the recycling ink supplying apparatus shown in FIG. 13.

Pressurizing purge in the ink supplying apparatus 100 shown in FIG. 13 includes processes shown in FIG. 14. More specifically, when the pressurizing purge is started (step S200), the processes of a membrane position fixing process (step S220), a pressure accumulation process (step S240), and an ink discharging process (step S260) are executed in this order and the pressurizing purge is then finished (step S290). In the membrane position fixing process (step S220), the respective steps (steps S120 to S132) of the membrane position fixing process (step S120) shown in FIG. 9 can be applied to the recovery valves 114-1, 114-2, . . . , **114-*n*, the air connection valve 134, the air valve 140, the recovery drain valve 130, and the recovery pump 120**.

Figure 15:
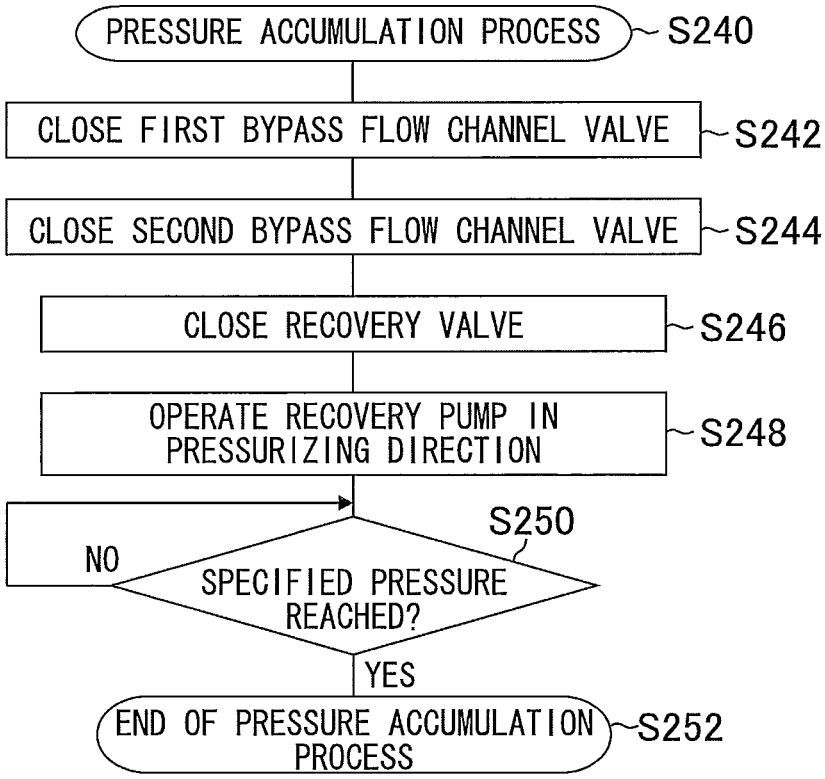
FIG. 15 is a flow chart showing a flow of control of a pressure accumulation process in the pressurizing purge control shown in FIG. 14.

FIG. 15 shows details of the pressure accumulation process (step S240 in FIG. 14). In the pressure accumulation process shown in FIG. 15, after closing the first and second bypass flow channel valves 194 and 196 and the recovery valves 114-1, 114-2, . . . , **114-*n* (steps S242 to S246), the recovery pump 120 is actuated in the pressurizing direction (step S248), and while monitoring the recovery-side pressure sensor 116, the pressure is accumulated in the recovery sub tank 118 until a specified pressure is reached (step S250**).

Figure 16:
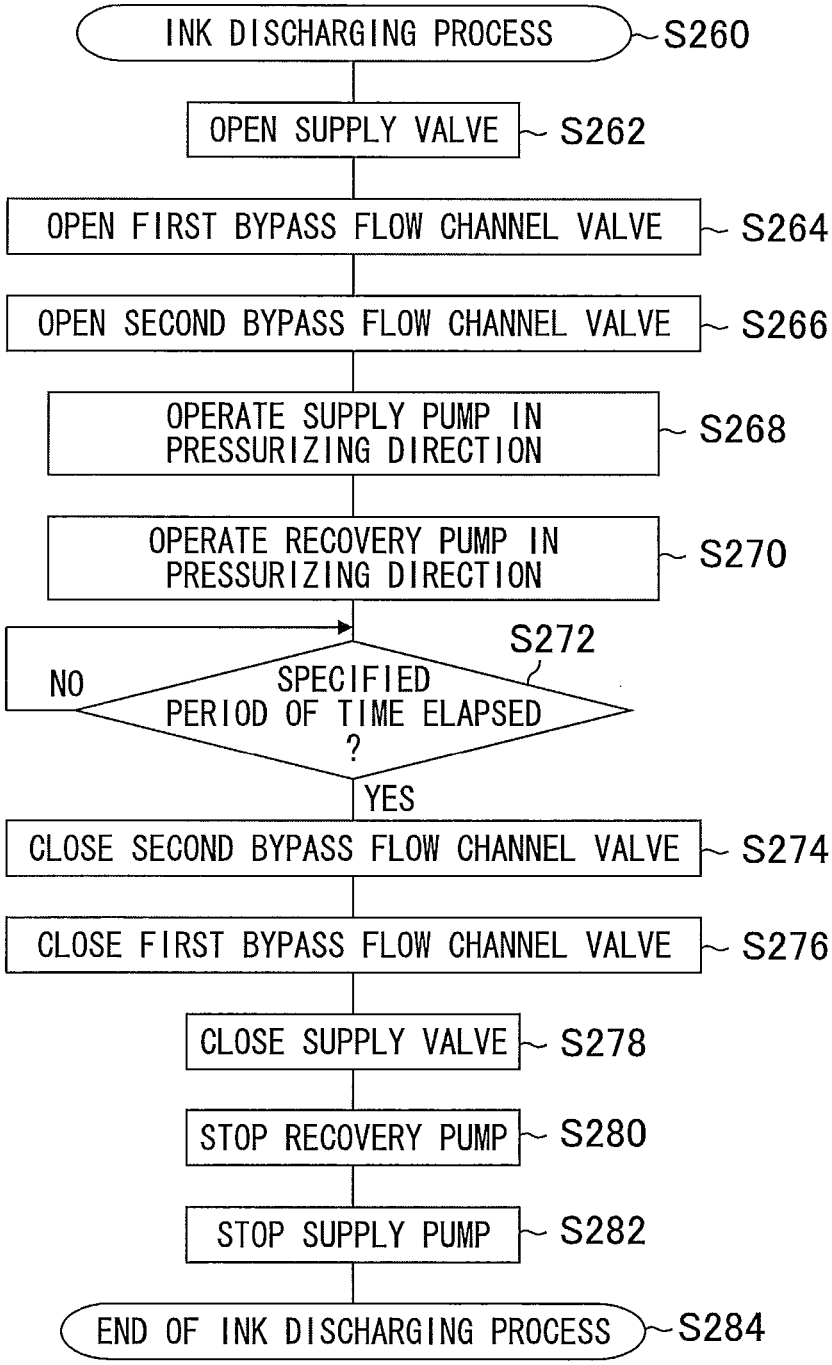
FIG. 16 is a flow chart showing a flow of control of an ink discharging process in the pressurizing purge control shown in FIG. 14.

FIG. 16 shows details of the ink discharging process (step S260 in FIG. 14). In the ink discharging process shown in FIG. 16, after opening one or more of the supply valves 14-1, 14-2, . . . , **14-*n* of the flow channels to be subjected to the pressurizing purge (step S262), the first and second bypass flow channel valves 194 and 196 are opened (steps S264 to S266). At this point, each of the supply pump 20 and the recovery pump 120 is actuated in the pressurizing direction to prevent the pressure from dropping (steps S268 to S270**).

After a predetermined period of time elapses from the start of discharge of the ink (Yes verdict in step S272), the second bypass flow channel valve 196 is closed (step S274), the first bypass flow channel valve 194 is closed (step S276), and the supply valves 14-1, 14-2, . . . , **14-*n* are closed (step S278). Subsequently, the recovery pump 120 is stopped (step S280), the supply pump 20 is stopped (step S282), and the ink discharging process is finished (step S284**).

The ink supplying apparatus 100 can be provided with the valve controller and the pump controller of the recovery system separately from the valve controller and the pump controller of the supply system (shown in FIG. 4), or the valve controller and the pump controller of the supply system can also serve as the valve controller and the pump controller of the recovery system.

Application Embodiments

Next, an inkjet recording apparatus, in which the ink supplying apparatus 10 or 100 described above is employed to the ink supply unit of an inkjet head, is described as an application embodiment of the present invention.

<General Configuration of Inkjet Recording Apparatus>

Figure 17:
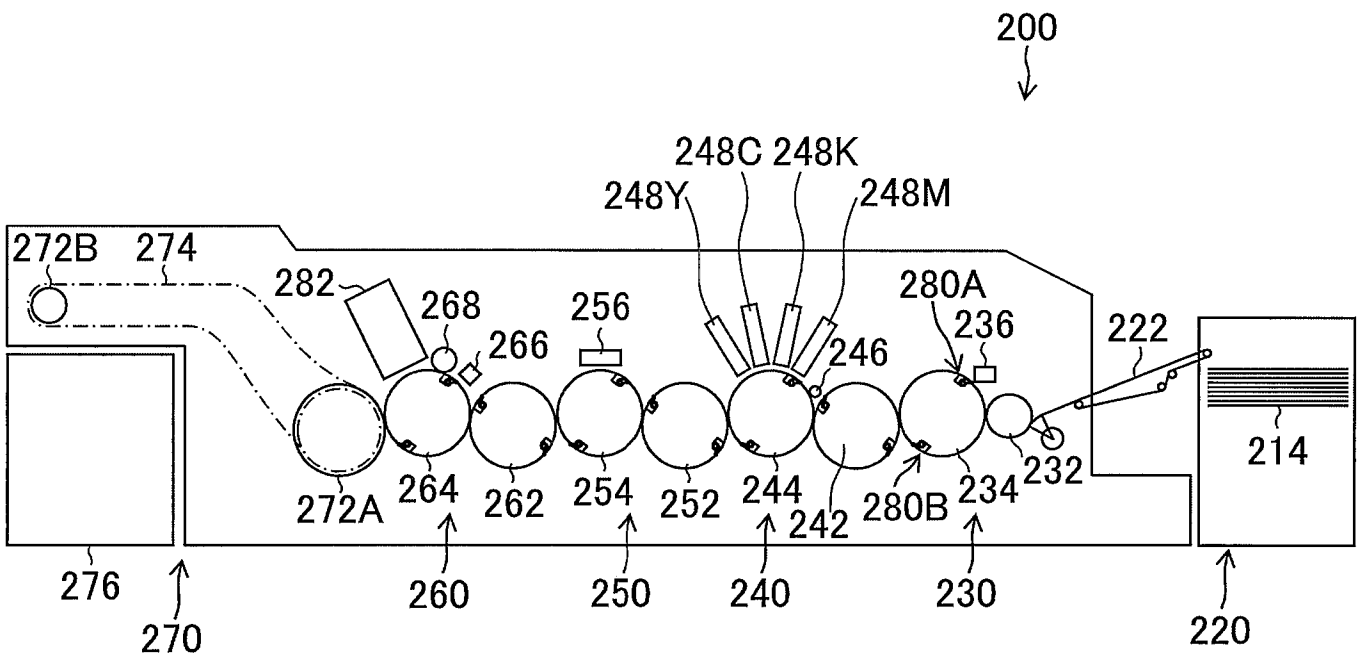
FIG. 17 is a general schematic drawing showing a configuration of an inkjet recording apparatus to which a liquid supplying apparatus according an embodiment of the present invention is applied.

FIG. 17 is a configuration diagram showing a general configuration of the inkjet recording apparatus including the liquid supplying apparatus according to an embodiment of the present invention. The inkjet recording apparatus 200 shown in FIG. 17 is a recording apparatus which adopts a two-liquid aggregation method in which ink containing a coloring material and an aggregation treatment liquid which functions to aggregate the ink are used to form an image on a recording surface of a recording medium 214 (e.g., a sheet of paper) in accordance with predetermined image data.

The inkjet recording apparatus 200 includes a paper supply unit 220, a treatment liquid application unit 230, an image formation unit 240, a drying unit 250, a fixing unit 260, and a discharging unit 270. While not shown in FIG. 17, the inkjet recording apparatus 200 is also provided with the ink supplying apparatus that supplies the ink to the image formation unit 240.

Transfer drums 232, 242, 252 and 262 are respectively arranged as devices to deliver the recording medium 214 conveyed to front sides of the treatment liquid application unit 230, the image formation unit 240, the drying unit 250 and the fixing unit 260. Pressure drums 234, 244, 254 and 264 are respectively arranged as devices for holding and conveying the recording medium 214 respectively in the treatment liquid application unit 230, the image formation unit 240, the drying unit 250 and the fixing unit 260.

Each of the transfer drums 232 to 262 and the pressure drums 234 to 264 is provided with grippers 280A and 280B, which nip and hold the leading end of the recording medium 214 at predetermined positions on the outer circumferential surface thereof. Structures of the grippers 280A and 280B for nipping and holding the leading end of the recording medium 214 and delivering the recording medium 214 to another gripper arranged on another pressure drum or transfer drum are the same. The gripper 280A and the gripper 280B are arranged at symmetrical positions on the outer circumferential surface of the pressure drum 234 with respect to a movement of 180 degrees of the pressure drum 234 in a rotational direction.

When each of the transfer drums 232 to 262 and the pressure drums 234 to 264 is rotated in a predetermined direction in a state where the leading end of the recording medium 214 is nipped by the gripper 280A or 280B, the recording medium 214 is rotationally conveyed along the outer circumferential surface of each of the transfer drums 232 to 262 and the pressure drums 234 to 264.

In FIG. 17, only the grippers 280A and 280B arranged on the pressure drum 234 are denoted with the reference numerals, and reference numerals are omitted for the grippers arranged on the other pressure drums and transfer drums.

When the recording medium 214 stored in the paper supply unit 220 is supplied to the treatment liquid application unit 230, the aggregation treatment liquid (hereinafter also referred to simply as the "treatment liquid") is applied to the recording surface of the recording medium 214 held on the outer circumferential surface of the pressure drum 234. The "recording surface of the recording medium 214" refers to an outside surface in a state where the recording medium 214 is being held on each of the pressure drums 234 to 264, or the surface opposite to the surface held on each of the pressure drums 234 to 264.

Subsequently, the recording medium 214 to which the aggregation treatment liquid has been applied is sent to the image formation unit 240. At the image formation unit 240, color ink is applied to a region on the recording surface to which the aggregation treatment liquid has been applied to form a desired image.

The recording medium 214 on which the color ink image has been formed is sent to the drying unit 250 where drying is performed on the recording medium 214. After the drying, the recording medium 214 is sent to the fixing unit 260 where fixing is performed on the recording medium 214. By performing the drying and fixing, the image formed on the recording medium 214 is hardened. Thus, the desired image is formed on the recording surface of the recording medium 214. After the image is fixed to the recording surface of the recording medium 214, the recording medium 214 is conveyed from the discharging unit 270 toward outside of the inkjet recording apparatus 200.

Hereinafter, respective units of the inkjet recording apparatus 200 (the paper supply unit 220, the treatment liquid application unit 230, the image formation unit 240, the drying unit 250, the fixing unit 260, and the discharging unit 270) are described in detail.

<Paper Supply Unit>

The paper supply unit 220 is provided with a paper supply tray 222 and a delivering mechanism (not shown), and is configured to deliver the recording medium 214 one sheet at a time from the paper supply tray 222. The recording medium 214 sent from the paper supply tray 222 is positioned by a guiding member (not shown) such that the leading end of the recording medium 214 is placed at a position of the gripper (not shown) of the transfer drum (paper supply drum) 232, and is temporarily stopped. Subsequently, the gripper (not shown) nips the leading end of the recording medium 214 and delivers the recording medium 214 to the gripper arranged on the treatment liquid drum 234.

<Treatment Liquid Application Unit>

The treatment liquid application unit 230 includes the treatment liquid drum 234, which holds the recording medium 214 delivered from the paper supply drum 232 on the outer circumferential surface and conveys the recording medium 214 in a predetermined conveyance direction, and a treatment liquid application device 236, which applies the treatment liquid on the recording surface of the recording medium 214 held on the outer circumferential surface of the treatment liquid drum 234. When the treatment liquid drum 234 is rotated counterclockwise in FIG. 17, the recording medium 214 is rotationally conveyed in the counterclockwise direction along the outer circumferential surface of the treatment liquid drum 234.

The treatment liquid application device 236 shown in FIG. 17 is arranged at a position opposing the outer circumferential surface (recording medium holding surface) of the treatment liquid drum 234. As a configuration of the treatment liquid application unit 230, a mode is possible which includes a treatment liquid container in which the treatment liquid is stored, a drawing roller of which a portion is immersed in the treatment liquid in the treatment liquid container and which draws up the treatment liquid in the treatment liquid container, and an application roller (rubber roller) which transfers the treatment liquid drawn up by the drawing roller onto the recording medium 214.

Moreover, in a favorable mode, the application roller is configured to include an application roller movement mechanism which is capable of moving the application roller with respect to the treatment liquid drum 234 along a normal of the outer circumferential surface of the treatment liquid drum 234 to prevent the treatment liquid from being deposited to portions other than the recording medium 214. The grippers 280A and 280B, which nip the leading end of the recording medium 214, are arranged not to protrude from the circumferential surface of the treatment liquid drum 234.

The treatment liquid that is applied to the recording medium 214 by the treatment liquid application unit 230 contains the coloring material aggregating agent which aggregates the coloring material (pigment) in the ink deposited by the image formation unit 240. When the treatment liquid and the ink come into contact with each other on the recording medium 214, separation of the coloring material and a solvent in the ink is promoted.

It is preferable that the treatment liquid application unit 230 applies the treatment liquid while measuring the amount of treatment liquid applied to the recording medium 214, and a film thickness of the treatment liquid on the recording medium 214 is sufficiently smaller than a diameter of ink droplets deposited in the image formation unit 240.

<Image Formation Unit>

The image formation unit 240 includes: an image formation drum 244, which holds and conveys the recording medium 214; a paper pressing roller 246, which brings the recording medium 214 into close contact with the image formation drum 244; and inkjet heads 248M, 248K, 248C and 248Y, which deposit droplets of the ink to the recording medium 214. The image formation drum 244 has the same basic structure with the treatment liquid drum 234 described above.

The paper pressing roller 246 is a guiding member for bringing the recording medium 214 into close contact with the outer circumferential surface of the image formation drum 244. The paper pressing roller 246 opposes the outer circumferential surface of the image formation drum 244 and is arranged downstream in the conveyance direction of the recording medium 214 from a delivery position of the recording medium 214 between the transfer drum 242 and the image formation drum 244, and upstream in the conveyance direction of the recording medium 214 from the inkjet heads 248M, 248K, 248C and 248Y.

A paper uplift measurement sensor (not shown) is arranged between the paper pressing roller 246 and the inkjet head 248Y furthest upstream in the conveyance direction of the recording medium 214. The paper uplift measurement sensor measures an amount of uplift immediately before the recording medium 214 enters beneath the inkjet heads 248M, 248K, 248C and 248Y. The inkjet recording apparatus 200 according to the present embodiment is configured such that, when an amount of uplift of the recording medium 214 as measured by the paper uplift measurement sensor exceeds a predetermined threshold, a notification to that effect is made and conveyance of the recording medium 214 is suspended.

The recording medium 214 delivered from the transfer drum 242 to the image formation drum 244 is pressed by the paper pressing roller 246 while being rotationally conveyed with the leading end of the recording medium 214 nipped by the grippers (of which reference numerals are omitted in FIG. 17), and comes into close contact with the outer circumferential surface of the image formation drum 244. After thereby bringing the recording medium 214 into close contact with the outer circumferential surface of the image formation drum 244, the recording medium 214 is sent to the print region beneath the inkjet heads 248M, 248K, 248C and 248Y in a state where there is no uplift of the recording medium 214 from the outer circumferential surface of the image formation drum 244.

The inkjet heads 248M, 248K, 248C and 248Y, which respectively correspond to the inks of four colors of magenta (M), black (K), cyan (C), and yellow (Y), are arranged in sequence from the upstream side in the rotational direction (the counterclockwise direction in FIG. 17) of the image formation drum 244 such that ink ejection surfaces (nozzle surfaces) of the inkjet heads 248M, 248K, 248C and 248Y face the recording surface of the recording medium 214 being held by the image formation drum 244. In this case, "ink ejection surfaces (nozzle surfaces)" refer to surfaces of the inkjet heads 248M, 248K, 248C and 248Y which face the recording surface of the recording medium 214 and on which nozzles 308 (shown in FIG. 19) for ejecting droplets of the inks (to be described later) are formed.

The inkjet heads 248M, 248K, 248C and 248Y shown in FIG. 17 are arranged inclined with respect to the horizontal plane such that each of the nozzle surfaces of the inkjet heads 248M, 248K, 248C and 248Y is substantially parallel to the recording surface of the recording medium 214 that is held on the image formation drum 244.

Each of the inkjet heads 248M, 248K, 248C and 248Y is a full line head having a length corresponding to a maximum width of the image formation region on the recording medium 214 (a dimension in the direction perpendicular to the conveyance direction of the recording medium 214) and is fixed so as to extend in the direction perpendicular to the conveyance direction of the recording medium 214. The ink is supplied to each of the inkjet heads 248M, 248K, 248C and 248Y from the ink supplying apparatus, which is described in detail later.

The nozzles for ejecting droplets of the ink are formed on each of the nozzle surfaces (liquid ejection surfaces) of the inkjet heads 248M, 248K, 248C and 248Y in a matrix arrangement across an entire width of the image formation region of the recording medium 214.

When the recording medium 214 is conveyed to the print region beneath the inkjet heads 248M, 248K, 248C and 248Y, droplets of the inks of the respective colors are ejected from the inkjet heads 248M, 248K 248C and 248Y in accordance with the image data and deposited to the region of the recording medium 214 where the aggregation treatment liquid has been applied.

When the droplets of the inks of the corresponding colors ejected from the inkjet heads 248M, 248K, 248C and 248Y are deposited on the recording surface of the recording medium 214 held on the outer circumferential surface of the image formation drum 244, the treatment liquid and the inks come into contact with each other on the recording medium 214, an aggregation reaction of coloring material dispersed in the inks (in a case of pigment-based coloring material) or insoluble coloring material (in a case of dye-based coloring material) occurs, and a coloring material aggregate is formed. Accordingly, movement of coloring material (displacement of dots, color unevenness of dots) in the image formed on the recording medium 214 is prevented.

Since the image formation drum 244 of the image formation unit 240 is structurally separated from the treatment liquid drum 234 of the treatment liquid application unit 230, the treatment liquid can be prevented from adhering to the inkjet heads 248M, 248K, 248C and 248Y, and thereby factors which result in ink ejection abnormality can be reduced.

While the configuration of the standard four colors of MKCY has been exemplified in the present embodiment, combinations of ink colors and number of colors are not limited to the present embodiment and a paler ink, a deeper ink, or an ink of special color may be added as necessary. For example, a configuration can be adopted in which inkjet heads which eject light inks such as light cyan and light magenta are added. Moreover, arrangement sequences of the respective color heads are not particularly restrictive.

<Drying Unit>

The drying unit 250 includes the drying drum 254, which holds and conveys the recording medium 214 after the image formation, and a drying device 256, which performs drying to vaporize moisture (liquid component) on the recording medium 214. The drying drum 254 has the same basic structure with the treatment liquid drum 234 and the image formation drum 244 described above, and the description thereof is hereby omitted.

The drying device 256 is arranged at a position facing the outer circumferential surface of the drying drum 254, and is a processing unit for vaporizing moisture existing on the recording medium 214. When the ink is deposited to the recording medium 214 in the image formation unit 240, a liquid component (solvent component) of the ink and a liquid component (solvent component) of the treatment liquid which are separated by the aggregation reaction of the treatment liquid and the ink remain on the recording medium 214, and such liquid components should be removed.

The drying device 256 is a processing unit which removes the liquid component existing on the recording medium 214 by performing drying in which the liquid component existing on the recording medium 214 is vaporized by heating with a heater, blowing with a fan, or a combination of both. An amount of heat or an amount of blown air applied to the recording medium 214 is set as appropriate according to parameters such as an amount of moisture remaining on the recording medium 214, a type of the recording medium 214, and a conveyance speed (drying duration) of the recording medium 214.

During the drying by the drying apparatus 256, since the drying drum 254 of the drying unit 250 is structurally separated from the image formation drum 244 of the image formation unit 240, factors which may lead to an abnormal ejection of ink due to drying of head meniscus portions caused by the heat or blown air can be reduced at the inkjet heads 248M, 248K, 248C and 248Y.

In order to take advantage of an effect of correcting cockling of the recording medium 214, it is desirable that the curvature of the drying drum 254 is not smaller than 0.002 (1/mm) Moreover, in order to prevent curving (curling) of the recording medium 214 after the drying, it is desirable that the curvature of the drying drum 254 is not larger than 0.0033 (1/mm).

The drying unit 250 desirably includes a device (for example, a built-in heater) for adjusting the surface temperature of the drying drum 254, whereby the surface temperature is desirably adjusted to not lower than 50° C. By applying heating from the rear surface of the recording medium 214, the drying is promoted and breakage of an image during a subsequent fixing stage can be prevented. In such a mode, a greater effect can be achieved by arranging a device which brings the recording medium 214 into close contact with the outer circumferential surface of the drying drum 254. Examples of the means for bringing the recording medium 214 into close contact include vacuum attraction and electrostatic attraction.

Moreover, while not particularly restricted, an upper limit of the surface temperature of the drying drum 254 is favorably set to not higher than 75° C. (more favorably, not higher than 60° C.) from the perspective of safety of maintenance work (preventing burns due to a high temperature) such as cleaning ink adhered to the surface of the drying drum 254.

By holding the recording medium 214 on the outer circumferential surface of the drying drum 254 configured as described above so that the recording surface of the recording medium 214 faces outward (i.e., in a state where the recording medium 214 is curved so that the recording surface thereof is a protruding side) and performing drying while rotationally conveying the recording medium 214, drying variances attributable to wrinkles or uplift of the recording medium 214 can be reliably prevented.

<Fixing Unit>

The fixing unit 260 includes: the fixing drum 264, which holds and conveys the recording medium 214; a heater 266, which applies heat to the recording medium 214 on which the image has been formed and from which the liquids have been removed; and a fixing roller 268, which presses the recording medium 214 from the side of the recording surface. The fixing drum 264 has the same basic structure with the treatment liquid drum 234, the image formation drum 244 and the drying drum 254, and the description thereof is hereby omitted. The heater 266 and the fixing roller 268 are arranged at positions opposing an outer circumferential surface of the fixing drum 264 in sequence from an upstream-side of a rotational direction (a counterclockwise direction as seen in FIG. 17) of the fixing drum 264.

At the fixing unit 260, preheating by the heater 266 and fixing by the fixing roller 268 are applied on the recording surface of the recording medium 214. The heating temperature of the heater 266 is set as appropriate according to the recording medium type, the ink type (the type of polymeric microparticles contained in the ink), and the like. For example, it is possible that the heating temperature of the heater 266 is set to the glass-transition temperature or the minimum film formation temperature of polymeric microparticles contained in the ink.

The fixing roller 268 is a roller member which applies heat and pressure to the dried ink in order to melt and fix the self-dispersible polymeric microparticles in the ink and to have the ink form a film, and is configured to apply heat and pressure to the recording medium 214. More specifically, the fixing roller 268 is arranged so as to be pressed against the fixing drum 264, and constitutes a nip roller with the fixing drum 264. Thus, the recording medium 214 is placed between the fixing roller 268 and the fixing drum 264, nipped under a prescribed nip pressure, and subjected to fixing.

Configuration examples of the fixing roller 268 include a mode in which the fixing roller 268 is formed as a heating roller in which a halogen lamp is incorporated into a pipe made of metal having high heat-conductivity, such as aluminum. By heating the recording medium 214 with the heating roller to apply thermal energy equal to or exceeding the glass-transition temperature of the polymeric microparticles contained in the ink, the polymeric microparticles melt to form a transparent film on the surface of the image.

When the recording surface of the recording medium 214 is pressed in this state, molten polymeric microparticles are pushed into and fixed to irregularities of the recording medium 214, the irregularities of the image surface are thereby leveled, and a favorable gloss can be obtained. Moreover, in another favorable configuration, a plurality of fixing rollers 268 are arranged in accordance with thicknesses of image layers and glass-transition temperature characteristics of the polymeric microparticles.

It is desirable that the fixing roller 268 has a surface hardness of not higher than 71°. By softening the surface of the fixing roller 268, an adherence effect to irregularities of the recording medium 214 created by cockling may be expected and uneven fixing attributable to the irregularities of the recording medium 214 can be prevented more effectively.

In the inkjet recording apparatus 200 shown in FIG. 17, an in-line sensor 282 is arranged at a subsequent stage (on a downstream-side in the recording medium conveyance direction) of the processing region of the fixing unit 260. The in-line sensor 282 is a sensor which reads the image formed on the recording medium 214 (or a check pattern formed in a margin region of the recording medium 214). A CCD line sensor is favorably used as the in-line sensor 282.

In the inkjet recording apparatus 200 according to the present embodiment, a presence/absence of an ejection abnormality of the inkjet heads 248M, 248K, 248C and 248Y is determined in accordance with a reading result of the in-line sensor 282. A mode can also be adopted in which the in-line sensor 282 includes a measuring device which measures a moisture amount, a surface temperature, gloss, and the like. In such a mode, according to the reading result of the moisture amount, the surface temperature, or gloss, parameters such as the drying temperature of the drying unit 250 and the heating temperature and pressure of the fixing unit 260 are adjusted as appropriate, and in correspondence with temperature variations inside the inkjet recording apparatus 200 or the temperature variations of the respective units in the inkjet recording apparatus 200, the control parameters described above are adjusted as appropriate.

<Discharging Unit>

As shown in FIG. 17, the discharging unit 270 is arranged subsequent to the fixing unit 260. The discharging unit 270 includes an endless conveying chain 274 wound around tension rollers 272A and 272B, and a discharge tray 276, which houses the recording medium 214 after image formation.

The recording medium 214 after the fixing sent from the fixing unit 260 is conveyed by the conveying chain 274 and discharged to the discharge tray 276.

<Structure of Inkjet Head>

Next, a structure of the inkjet heads 248M, 248K, 248C and 248Y arranged in the image formation unit 240 is described. The inkjet heads 248M, 248K, 248C and 248Y corresponding to the respective colors have the same structure, and an inkjet head (hereinafter also referred to simply as a "head") is hereinafter described for example and denoted with reference numeral 300.

Figure 18:
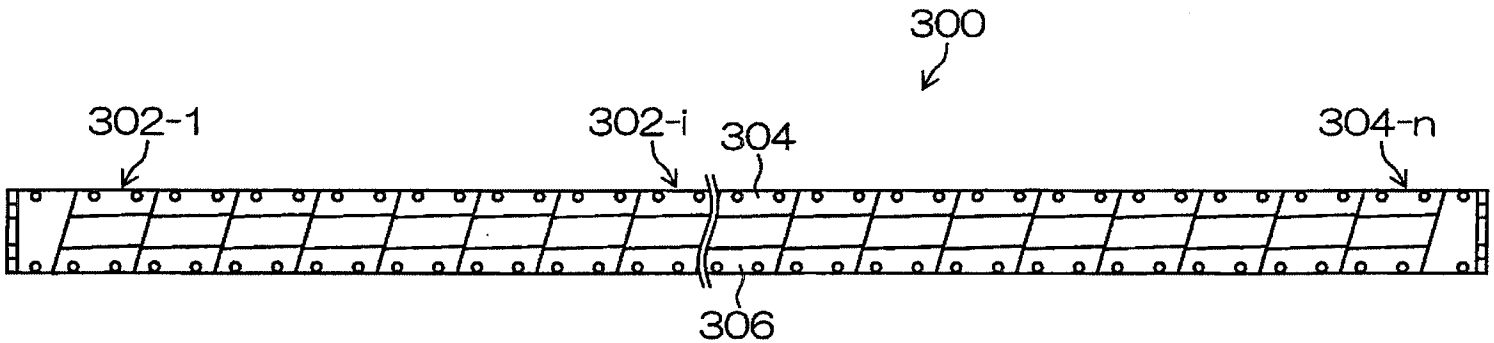
FIG. 18 is a plan transparent view showing a configuration of an inkjet head mounted to the inkjet recording apparatus shown in FIG. 17.

FIG. 18 is a schematic configuration diagram of an inkjet head 300 which is depicted as a recording surface of a recording medium is viewed through the inkjet head 300 (a plan transparent view of the head). The head 300 shown in FIG. 18 has a multi-head configuration in which n head modules 302-*i* (where i is an integer between 1 and n) are joined together in a single line along the lengthwise direction of the head 300. Each head module 302-*i* is supported by head covers 304 and 306 from both ends in the breadthways direction of the head 300. Moreover, a multi-head may also be configured by arranging the head modules 302-*i* in a staggered pattern.

Applications of a multi-head configured by a plurality of head modules include a full line head, which corresponds to an entire width of the recording medium. The full line head has a structure in which, with respect to the direction (main scanning direction) perpendicular to the direction (sub-scanning direction) of movement of the recording medium, a plurality of nozzles 308 (shown in FIG. 19) are arranged so as to correspond to the dimension (width) of the recording medium in the main scanning direction. With a so-called single pass image recording method in which an image is recorded by relatively scanning the recording medium only once with the head 300 structured as described above, an image may be formed across an entire surface of the recording medium.

The head module 302-*i* constituting the head 300 has an approximately parallelogrammatic planar shape, and overlapping portions are provided between adjacent head modules. The overlapping portion is a joint of the adjacent head modules, and dots which are adjacent to each other on the recording medium in the arrangement direction of the head modules 302-*i* are formed by the nozzles which are in the overlapping portion and belong to different head modules. The head 300 shown in FIG. 18 corresponds to the head 50' shown in FIG. 5, and the head modules 302-*i* correspond to the head modules 51-1, 51-2, . . . , 51-*n*.

Figure 19:
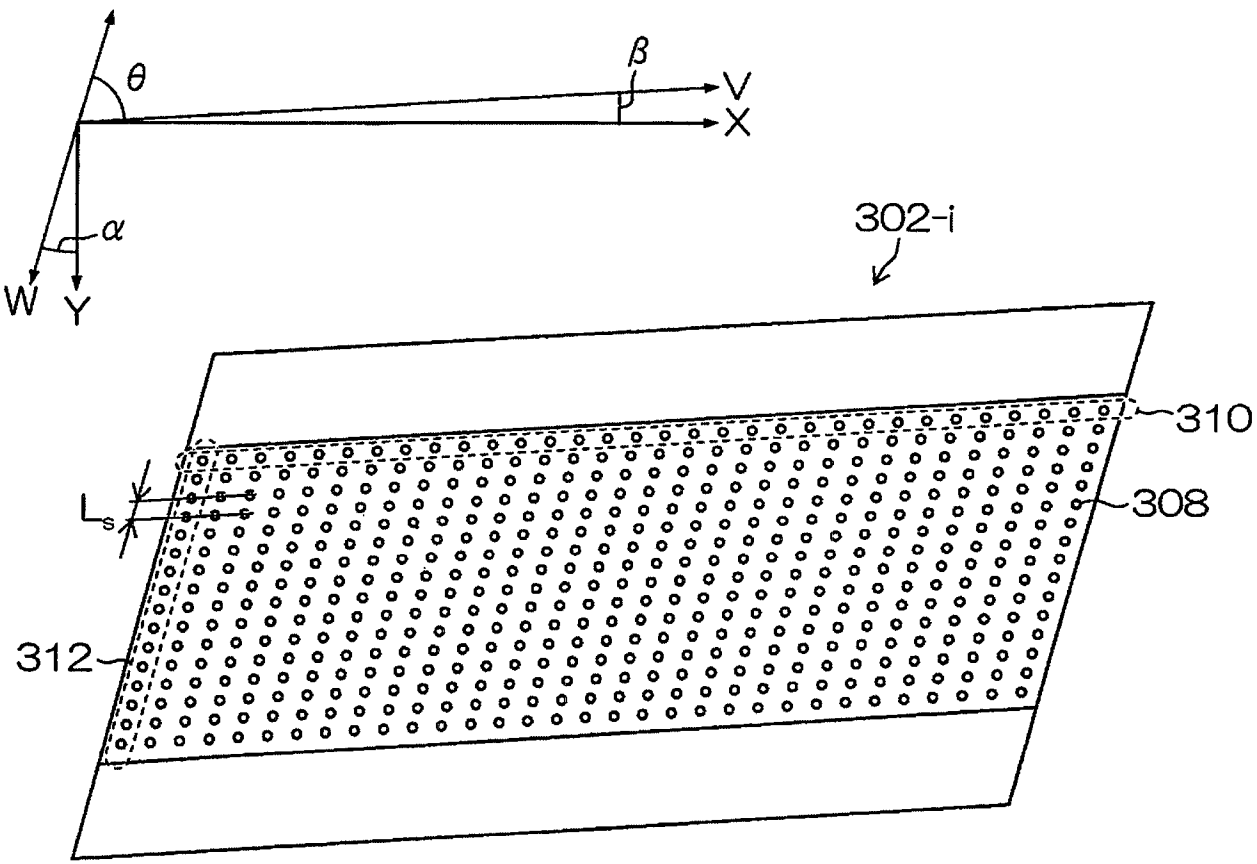
FIG. 19 is a plan view illustrating a nozzle arrangement of the inkjet head shown in FIG. 18.

FIG. 19 is a plan view showing a nozzle arrangement of the head module 302-*i*. As shown in FIG. 19, each head module 302-*i* has a structure in which the nozzles 308 are arranged in a two-dimensional pattern. A head provided with the head module 302-*i* is a so-called matrix head. The head module 302-*i* shown in FIG. 19 has a structure in which a large number of nozzles 308 are arranged along a column direction W which forms an angle $\alpha$ with respect to the sub-scanning direction Y and a row direction V which forms an angle $\beta$ with respect to the main scanning direction X, and substantially achieves a high nozzle arrangement density in the main scanning direction X. In FIG. 19, a group of nozzles (nozzle row) aligned along the row direction V is denoted with reference numeral 310, and a group of nozzles (nozzle column) aligned along the column direction W is denoted with reference numeral 312.

Moreover, other examples of the matrix arrangement of the nozzles 308 include a configuration in which a plurality of nozzles 308 are arranged along a row direction which coincides with the main scanning direction X and a column direction which is inclined with respect to the main scanning direction X.

Figure 20:
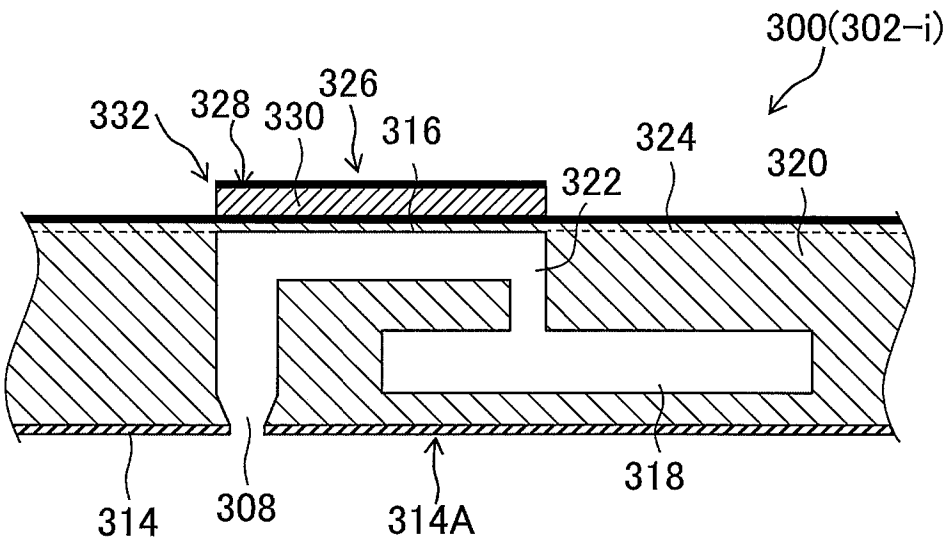
FIG. 20 is a cross-sectional view showing an inner structure of the inkjet head shown in FIG. 18.

FIG. 20 is a cross-sectional view showing an inner structure of a droplet ejection element corresponding to a single channel (an ink chamber unit corresponding to one of the nozzles 308) which constitutes a recording element unit. As shown in FIG. 20, the head 300 (the head module 302-*i*) according to the present embodiment has a laminated structure in which a nozzle plate 314 in which the nozzle 308 is formed, a flow channel plate 320 in which a pressure chamber 316 and flow channels such as a common flow channel 318 are formed, and the like, are bonded together. The nozzle plate 314 constitutes a nozzle surface 314A of the head 300. The plurality of nozzles 308 respectively connected to the pressure chambers 316 are two-dimensionally formed on the nozzle plate 314.

The flow channel plate 320 is a flow channel forming member which constitutes side wall parts of the pressure chamber 316 and which forms a supply port 322 as a regulator (a narrowest portion) of an individual supply channel through which the ink is sent from the common flow channel 318 to the pressure chamber 316. While a simplified illustration is presented in FIG. 20 for the sake of description, the flow channel plate 320 has a laminated structure formed of one or more substrates.

The nozzle plate 314 and the flow channel plate 320 can be made of silicon and processed into desired shapes by a semiconductor manufacturing process.

The common flow channel 318 is connected to an ink tank (not shown), which is an ink supply source. The ink supplied from the ink tank is sent to each pressure chamber 316 through the common flow channel 318.

A piezoelectric actuator 332 is bonded to a diaphragm 324, which partially constitutes a face (a ceiling face in FIG. 20) of the pressure chamber 316. The piezoelectric actuator 332 includes an individual electrode 326 and a lower electrode 328, and has a structure in which a piezoelectric body 330 is disposed between the individual electrode 326 and the lower electrode 328. When the diaphragm 324 is constituted of a metallic thin film or a metallic oxide film, the diaphragm 324 also serves as a common electrode which is equivalent to the lower electrode 328 of the piezoelectric actuator 332. In a mode where the diaphragm 324 is formed of a nonconductive material such as resin, a lower electrode layer made of a conductive material such as metal is formed on the surface of the diaphragm 324.

A drive voltage applied to the individual electrode 326 causes the piezoelectric actuator 332 to deform and a capacity of the pressure chamber 316 to change, whereby the ink is ejected from the nozzle 308 due to a variation in pressure accompanying the change in capacity. When the piezoelectric actuator 332 returns to the original state after the ink has been ejected, new ink is supplied from the common flow channel 318 through the supply port 322 to refill the pressure chamber 316.

The high-density nozzle head according to the present embodiment is achieved as shown in FIG. 19 by arranging the large number of ink chamber units structured as described above in the arrangement pattern along the row direction V which forms the angle $\beta$ with respect to the main scanning direction X and the column direction W which forms the angle $\alpha$ with respect to the sub-scanning direction Y. In the matrix arrangement, when a pitch between adjacent nozzles in the sub-scanning direction Y is Ls, then the nozzle arrangement in the main scanning direction X can be considered substantially equivalent to a linear arrangement of the nozzles 308 at a constant pitch expressed as $P=Ls/\tan\theta$.

While the piezoelectric actuator 332 has been applied in the present embodiment as an ejection force generating device of ink to be ejected from the nozzle 308 arranged in the head 300, a thermal method can also be applied in which a heater is arranged in the pressure chamber 316 and ink is ejected using a pressure of film boiling due to heating by the heater.

<Description of Control System>

Figure 21:
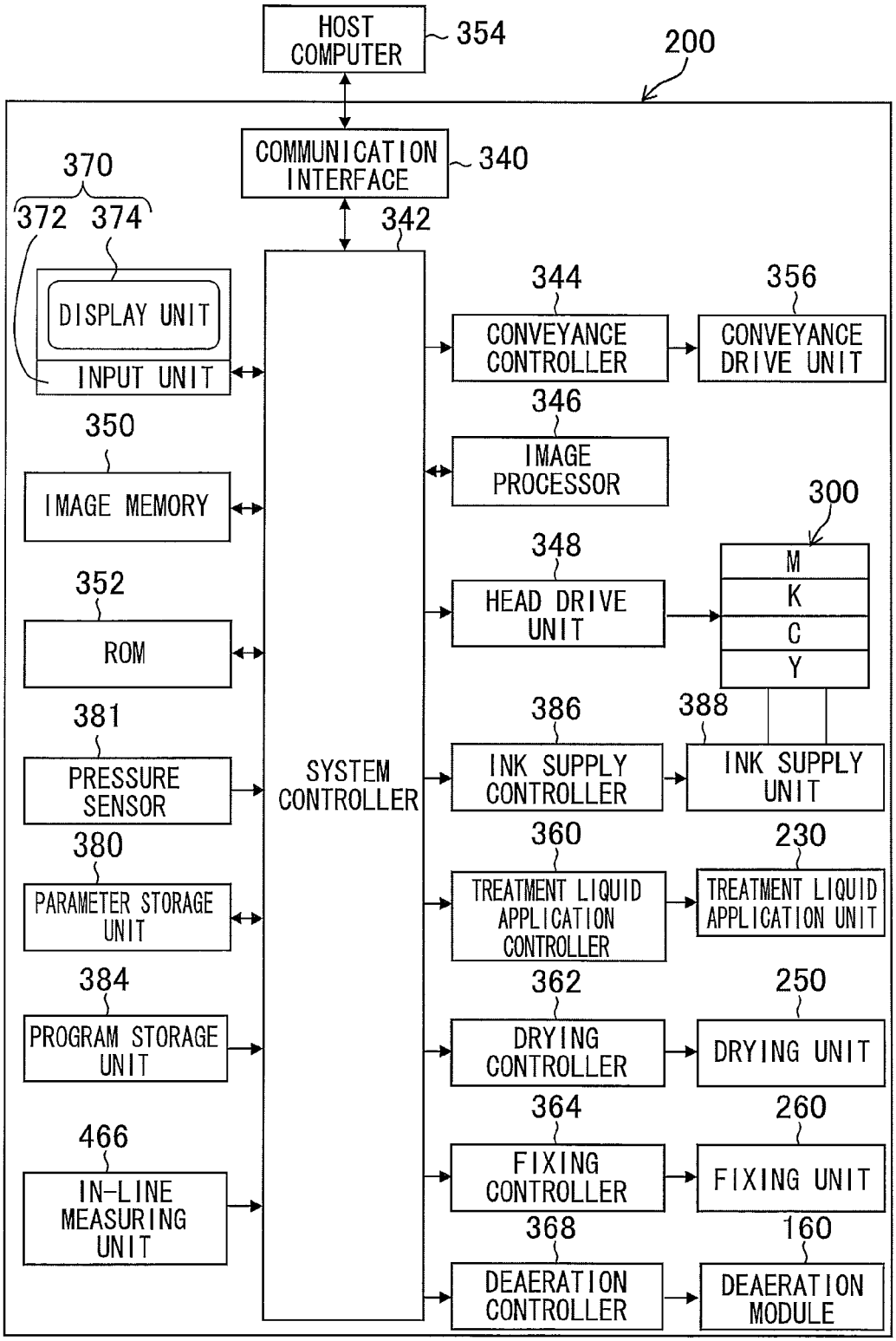
FIG. 21 is a principal block diagram showing a configuration of controllers applied to the inkjet recording apparatus shown in FIG. 17.

FIG. 21 is a block diagram showing a schematic configuration of a control system of the inkjet recording apparatus 200. The inkjet recording apparatus 200 includes a communication interface 340, a system controller 342, a conveyance controller 344, an image processor 346, and a head drive unit 348, an image memory 350, and a ROM 352.

The communication interface 340 is an interface unit which receives image data sent from a host computer 354. A serial interface such as USB (Universal Serial Bus) or a parallel interface such as Centronix can be applied as the communication interface 340. The communication interface 340 may be provided with a buffer memory (not shown) for increasing communication speed.

The system controller 342 includes a central processing unit (CPU), peripheral circuitry thereof, and the like, and functions as a control apparatus which controls the entire inkjet recording apparatus 200 according to a predetermined program, as an operational unit which performs various computations, and as a memory controller of the image memory 350 and the ROM 352. More specifically, the system controller 342 controls various units such as the communication interface 340 and the conveyance controller 344, controls communication with the host computer 354, controls read/write to/from the image memory 350 and the ROM 352, and also generates control signals for controlling the various units described above.

Image data transmitted from the host computer 354 is received by the inkjet recording apparatus 200 through the communication interface 340 and subjected to predetermined image processing by the image processor 346.

The image processor 346 is a controller having a signal (image) processing function for performing a variety of processing and correction operations for generating a print control signal from the image data, and supplies generated printing data to the head drive unit 348. Necessary image processing is performed by the image processor 346. According to the image data, an ejection amount of droplet (droplet ejection amount) and ejection timing of the head 300 are controlled through the head drive unit 348. Accordingly, a desired dot size and dot arrangement are realized. Moreover, the head drive unit 348 shown in FIG. 21 may include a feedback control system for maintaining a constant drive condition of the head 300.

The conveyance controller 344 controls the conveyance timing and the conveyance speed of the recording medium 214 (shown in FIG. 17) according to the print control signal generated by the image processor 346. A conveyance drive unit 356 shown in FIG. 21 includes motors for rotating the pressure drums 234 to 264 and motors for rotating the transfer drums 232 to 262 shown in FIG. 17, a motor of an advancing mechanism for the recording medium 214 in the paper supply unit 220, a motor for driving the tension rollers 272A and 272B of the discharging unit 270 and the like, and the conveyance controller 344 functions as a driver of the motors described above.

The image memory (primary storage memory) 350 functions as a primary storage device for temporarily storing the image data inputted through the communication interface 340, as an expansion area for various programs stored in the ROM 352, and as an operational work area for the CPU (for example, a work area for the image processor 346). A volatile memory capable of sequential read/write (RAM) is used as the image memory 350.

The ROM 352 stores programs which are executed by the CPU of the system controller 342 as well as various data and control parameters necessary for controlling the respective parts of the inkjet recording apparatus 200. Read/write of data of the ROM 352 is performed through the system controller 342. The ROM 352 can be a memory constituted of semiconductor elements, a magnetic medium such as a hard disk. It is also possible to provide an external interface so as to use an attachable/detachable storage medium as the ROM 352.

The inkjet recording apparatus 200 further includes a treatment liquid application controller 360, a drying controller 362, and a fixing controller 364, which respectively control operations of the treatment liquid application unit 230, the drying unit 250, and the fixing unit 260 according to instructions from the system controller 342.

The treatment liquid application controller 360 controls a timing of treatment liquid application and a treatment liquid application amount in accordance with the print data obtained from the image processor 346. The drying controller 362 controls a timing of drying by the drying apparatus 256 as well as the drying temperature, an amount of blown air, and the like. The fixing controller 364 controls the temperature of the heater 266 and pressure applied by the fixing roller 268.

An in-line measuring unit 466 including the in-line sensor 282 shown in FIG. 17 is a processing block including a signal processor which performs predetermined signal processing such as noise reduction, amplification, and waveform shaping on a readout signal outputted from the in-line sensor 282. The system controller 342 determines a presence/absence of an ejection abnormality of the head 300 in accordance with a measurement signal obtained by the in-line measuring unit 466.

An ink supply controller 386 controls supply of the ink to the head 300 by an ink supply unit 388. Specific examples of the ink supply controller 386 include the configuration shown in FIG. 4. Moreover, the above-described ink supply apparatus 10 or 100 is employed to the ink supply unit 388 in FIG. 21.

The inkjet recording apparatus 200 according to the present embodiment includes a user interface 370. The user interface 370 has an input unit 372 which is used by an operator (user) to perform various input, and a display unit (display) 374. Various forms such as a keyboard, a mouse, a touch panel, and a button may be adopted as the input unit 372. By operating the input unit 372, the operator can enter a print condition, select an image quality mode, enter and edit supplementary information, search information, and the like. The operator can confirm various information such as an entered content or a search result through a display by the display unit 374. The display unit 374 also functions as a device for displaying warnings such as an error message. Moreover, the display unit 374 in FIG. 21 can be applied as a display which constitutes the display unit 75 in the control system shown in FIG. 4.

A deaeration controller 378 controls operations of the deaeration module 160, which performs deaeration on the liquid sent from the ink tank 52 (shown in FIG. 1) to the head 300.

A parameter storage unit 380 stores various control parameters necessary for operations of the inkjet recording apparatus 200. The system controller 342 reads out the parameters necessary for control as appropriate, and executes updating (rewriting) of the various parameters as required.

The pressure sensor 381 (corresponding to the pressure sensors 16 and 116) includes the pressure measurement element for measuring the pressure in the ink flow channel, and converts measured pressure information into an electric signal and provide the electric signal to the system controller 342. The system controller 342 sends a command signal to the ink supply controller 386 to adjust an operation (rotational speed) of the pump included in the ink supply unit 388 in accordance with the pressure information.

A program storage unit 384 is a storage device which stores the control programs for operating the inkjet recording apparatus 200. Stored control programs include the control programs for the supply pump 20 included in the ink supply unit 388, the recovery pump 120, the deaeration module 160, the heat exchanger 166, and the like.

<Applications to Other Apparatus Configurations>

While the inkjet recording apparatus has been described as the application embodiment of the image formation apparatus according to in the present invention, an applicable range of the present invention is not limited to applications related to so-called graphic printing such as photo printing and poster printing, and also encompasses industrial apparatuses capable of forming patterns that can be recognized as images such as a resist printing apparatus, a wiring image formation apparatus for an electronic circuit board, and a microstructure forming apparatus.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid supplying apparatus configured to supply liquid to a liquid supply object, the apparatus comprising:

a supply flow channel which is connected to the liquid supply object;

a first pressure applying device which applies pressure to the liquid inside the supply flow channel;

a first pressure buffering unit including a first liquid chamber which is connected to the supply flow channel, a first gas chamber which stores a gas, and a first partition which separates the first liquid chamber and the first gas chamber from each other, the first partition being deformable or movable so as to vary a volume of the first liquid chamber;

a first gas flow channel of which one end is connected to the first gas chamber;

a first gas storage unit which is connected to the other end of the first gas flow channel;

a first gas flow channel switching device which opens and closes to connect and disconnect the first gas chamber and the first gas storage unit to and from each other;

a first atmosphere connection channel of which one end is connected to the first gas storage unit and the other end is connected to atmosphere;

a first atmosphere connection channel switching device which opens and closes to connect and disconnect the first gas storage unit to and from the atmosphere;

a first switching controlling device which controls operations of the first gas flow channel switching device and the first atmosphere connection channel switching device during initial position adjustment of the first partition and during pressurization of the liquid supply object; and a first pressure controlling device which controls an operation of the first pressure applying device in response to the operations of the first gas flow channel switching device and the first atmosphere connection channel switching device controlled by the first switching controlling device.

2. The liquid supplying apparatus as defined in claim 1, wherein:

upon start of the initial position adjustment of the first partition, the first switching controlling device controls the first gas flow channel switching device and the first atmosphere connection channel switching device to open, and when the first partition becomes adjusted to an initial position, the first switching controlling device then controls the first atmosphere connection channel switching device to close; and when the first switching controlling device controls the first gas flow channel switching device and the first atmosphere connection channel switching device to open during the initial position adjustment of the first partition, the first pressure controlling device controls the first pressure applying device to pressurize the first liquid chamber to expand the first liquid chamber further than that in an initial state in which the first partition is at the initial position, and when the first liquid chamber reaches a predetermined volume, the first pressure controlling device then controls the first pressure applying device to depressurize the first liquid chamber to cause the first liquid chamber to contract by an amount equivalent to an amount of expansion from the initial state.

3. The liquid supplying apparatus as defined in claim 2, further comprising:

a first pressure measuring device which measures pressure of the supply flow channel or the first liquid chamber; and a first data storage device in which a relationship between the pressure measured by the first pressure measuring device and the volume of the first liquid chamber is stored, wherein the first pressure controlling device controls the first pressure applying device to stop when a measurement result of the first pressure measuring device assumes a specified pressure stored in the first data storage device correspondingly to the volume of the first liquid chamber when the first liquid chamber is expanded further than that in the initial state.

4. The liquid supplying apparatus as defined in claim 2, wherein the first pressure controlling device controls the first pressure applying device to operate for a predetermined period of time to cause the liquid inside the first liquid chamber to be discharged at a certain flow rate when contracting the first liquid chamber further than that in a state in which the first liquid chamber has been expanded during the initial position adjustment of the first partition.

5. The liquid supplying apparatus as defined in claim 1, wherein:

upon start of the pressurization of the liquid supply object, the first switching controlling device controls the first gas flow channel switching device and the first atmosphere connection channel switching device to open, and when the first partition becomes deformed or moved to maximize the volume of the first liquid chamber, the first switching controlling device then controls the first gas flow channel switching device and the first atmosphere connection channel switching device to close; and when the first switching controlling device controls the first gas flow channel switching device and the first atmosphere connection channel switching device to open during the pressurization of the liquid supply object, the first pressure controlling device controls the first pressure applying device to pressurize the first liquid chamber to deform or move the first partition and operates to cause the volume of the first liquid chamber to become maximum.

6. The liquid supplying apparatus as defined in claim 5, wherein when the first partition becomes deformed or moved to maximize the volume of the first liquid chamber and the first switching controlling device controls the first gas flow channel switching device and the first atmosphere connection channel switching device to close, the first pressure controlling device controls the first pressure applying device to pressurize the supply flow channel so as to pressurize the liquid supply object.

7. The liquid supplying apparatus as defined in claim 1, wherein the first pressure buffering unit includes:

a flexible membrane which serves as the first partition; and a sealed container which is separated by the flexible membrane into the first liquid chamber and the first gas chamber.

8. The liquid supplying apparatus as defined in claim 1, wherein in the first pressure buffering unit, an inner wall of the first gas chamber has a curved surface.

9. The liquid supplying apparatus as defined in claim 1, further comprising:

a recovery flow channel which is connected to the liquid supply object;

a second pressure applying device which applies pressure to the liquid inside the recovery flow channel;

a second pressure buffering unit including a second liquid chamber which is connected to the recovery flow channel, a second gas chamber which stores a gas, and a second partition which separates the second liquid chamber and the second gas chamber from each other, the second partition being deformable or movable so as to vary a volume of the second liquid chamber;

a second gas flow channel of which one end is connected to the second gas chamber;

a second gas storage unit which is connected to the other end of the second gas flow channel;

a second gas flow channel switching device which opens and closes to connect and disconnect the second gas chamber and the second gas storage unit to and from each other;

a second atmosphere connection channel of which one end is connected to the second gas storage unit and the other end is connected to the atmosphere;

a second atmosphere connection channel switching device which opens and closes to connect and disconnect the second gas storage unit to and from the atmosphere;

a second switching controlling device which controls operations of the second gas flow channel switching device and the second atmosphere connection channel switching device during recycling in which the liquid is recycled from the liquid supply object through the recovery flow channel, during initial position adjustment of the second partition, and during pressurization of the liquid supply object; and a second pressure controlling device which controls an operation of the second pressure applying device in response to the operations of the second gas flow channel switching device and the second atmosphere connection channel switching device controlled by the second switching controlling device.

10. The liquid supplying apparatus as defined in claim 9, wherein during the recycling in which the liquid is recycled from the liquid supply object through the recovery flow channel:

the first switching controlling device controls the operations of the first gas flow channel switching device and the first atmosphere connection channel switching device; and the first pressure controlling device controls the first pressure applying device in response to the operations of the first gas flow channel switching device and the first atmosphere connection channel switching device controlled by the first switching controlling device.

11. The liquid supplying apparatus as defined in claim 9, wherein during the recycling in which the liquid is recycled from the liquid supply object through the recovery flow channel:

the first switching controlling device controls the first gas flow channel switching device to open and controls the first atmosphere connection channel switching device to close;

the second switching controlling device controls the second gas flow channel switching device to open and controls the second atmosphere connection channel switching device to close;

the first pressure controlling device controls the first pressure applying device to generate a pressure difference between the supply flow channel and the recovery flow channel; and the second pressure controlling device controls the second pressure applying device to generate the pressure difference between the supply flow channel and the recovery flow channel.

12. The liquid supplying apparatus as defined in claim 9, further comprising:

a connection flow channel through which the supply flow channel and the recovery flow channel are connected to each other;

a connection flow channel switching device which opens and closes to connect and disconnect the supply flow channel and the recovery flow channel to and from each other; and a connection flow channel switching controlling device which controls an operation of the connection flow channel switching device so as to connect the supply flow channel and the recovery flow channel to each other during the recycling in which the liquid is recycled from the liquid supply object through the recovery flow channel.

13. The liquid supplying apparatus as defined in claim 9, wherein:

upon start of the initial position adjustment of the second partition, the second switching controlling device controls the second gas flow channel switching device and the second atmosphere connection channel switching device to open, and when the second partition becomes adjusted to an initial position, the second switching controlling device then controls the second atmosphere connection channel switching device to close; and when the second switching controlling device controls the second gas flow channel switching device and the second atmosphere connection channel switching device to open during the initial position adjustment of the second partition, the second pressure controlling device controls the second pressure applying device to pressurize the second liquid chamber to expand the second liquid chamber further than that in an initial state in which the second partition is at the initial position, and when the second liquid chamber reaches a predetermined volume, the second pressure controlling device then controls the second pressure applying device to depressurize the second liquid chamber to cause the second liquid chamber to contract by an amount equivalent to an amount of expansion from the initial state.

14. The liquid supplying apparatus as defined in claim 13, further comprising:

a second pressure measuring device which measures pressure of the recovery flow channel or the second liquid chamber; and a second data storage device in which a relationship between the pressure measured by the second pressure measuring device and the volume of the second liquid chamber is stored, wherein the second pressure controlling device controls the second pressure applying device to stop when a measurement result of the second pressure measuring device assumes a specified pressure stored in the second data storage device correspondingly to the volume of the second liquid chamber when the second liquid chamber is expanded further than that in the initial state.

15. The liquid supplying apparatus as defined in claim 13, wherein the second pressure controlling device controls the second pressure applying device to operate for a predetermined period of time to cause the liquid inside the second liquid chamber to be discharged at a certain flow rate when contracting the second liquid chamber further than that in a state in which the second liquid chamber has been expanded during the initial position adjustment of the second partition.

16. The liquid supplying apparatus as defined in claim 13, wherein:

upon start of the pressurization of the liquid supply object, the second switching controlling device controls the second gas flow channel switching device and the second atmosphere connection channel switching device to open, and when the second partition becomes deformed or moved to maximize the volume of the second liquid chamber, the second switching controlling device then controls the second gas flow channel switching device and the second atmosphere connection channel switching device to close; and when the second switching controlling device controls the second gas flow channel switching device and the second atmosphere connection channel switching device to open during the pressurization of the liquid supply object, the second pressure controlling device controls the second pressure applying device to pressurize the second liquid chamber to deform or move the second partition and operates to cause the volume of the second liquid chamber to become maximum.

17. The liquid supplying apparatus as defined in claim 16, wherein when the second partition becomes deformed or moved to maximize the volume of the second liquid chamber and the second switching controlling device controls the second gas flow channel switching device and the second atmosphere connection channel switching device to close, the second pressure controlling device controls the second pressure applying device to pressurize the supply flow channel so as to pressurize the liquid supply object.

18. The liquid supplying apparatus as defined in claim 9, wherein the second pressure buffering unit includes:

a flexible membrane which serves as the second partition; and a sealed container which is separated by the flexible membrane into the second liquid chamber and the second gas chamber.

19. The liquid supplying apparatus as defined in claim 9, wherein in the second pressure buffering unit, an inner wall of the second gas chamber has a curved surface.

20. A liquid ejecting apparatus, comprising:

a liquid ejection head which ejects liquid; and a liquid supplying apparatus which supplies the liquid to the liquid ejection head, wherein the liquid supplying apparatus includes:

a supply flow channel which is connected to the liquid ejection head;

a first pressure applying device which applies pressure to the liquid inside the supply flow channel;

a first pressure buffering unit including a first liquid chamber which is connected to the supply flow channel, a first gas chamber which stores a gas, and a first partition which separates the first liquid chamber and the first gas chamber from each other, the first partition being deformable or movable so as to vary a volume of the first liquid chamber;

a first gas flow channel of which one end is connected to the first gas chamber;

a first gas storage unit which is connected to the other end of the first gas flow channel;

a first gas flow channel switching device which opens and closes to connect and disconnect the first gas chamber and the first gas storage unit to and from each other;

a first atmosphere connection channel of which one end is connected to the first gas storage unit and the other end is connected to atmosphere;

a first atmosphere connection channel switching device which opens and closes to connect and disconnect the first gas storage unit to and from the atmosphere;

a first switching controlling device which controls operations of the first gas flow channel switching device and the first atmosphere connection channel switching device during initial position adjustment of the first partition and during pressurization of the liquid ejection head; and a first pressure controlling device which controls an operation of the first pressure applying device in response to the operations of the first gas flow channel switching device and the first atmosphere connection channel switching device controlled by the first switching controlling device.

21. The liquid ejecting apparatus as defined in claim 20, further comprising:

a recovery flow channel which is connected to the liquid ejection head;

a second pressure applying device which applies pressure to the liquid inside the recovery flow channel;

a second pressure buffering unit including a second liquid chamber which is connected to the recovery flow channel, a second gas chamber which stores a gas, and a second partition which separates the second liquid chamber and the second gas chamber from each other, the second partition being deformable or movable so as to vary a volume of the second liquid chamber;

a second gas flow channel of which one end is connected to the second gas chamber;

a second gas storage unit which is connected to the other end of the second gas flow channel;

a second gas flow channel switching device which opens and closes to connect and disconnect the second gas chamber and the second gas storage unit to and from each other;

a second atmosphere connection channel of which one end is connected to the second gas storage unit and the other end is connected to the atmosphere;

a second atmosphere connection channel switching device which opens and closes to connect and disconnect the second gas storage unit to and from the atmosphere;

a second switching controlling device which controls operations of the second gas flow channel switching device and the second atmosphere connection channel switching device during recycling in which the liquid is recycled from the liquid ejection head through the recovery flow channel, during initial position adjustment of the second partition, and during pressurization of the liquid ejection head; and a second pressure controlling device which controls an operation of the second pressure applying device in response to the operations of the second gas flow channel switching device and the second atmosphere connection channel switching device controlled by the second switching controlling device.

* * * * *